US008926076B2

(12) United States Patent
Kobayashi et al.

(10) Patent No.: US 8,926,076 B2
(45) **Date of Patent: *Jan. 6, 2015**

(54) IMAGE FORMING APPARATUS

(75) Inventors: Takeyuki Kobayashi, Kanagawa (JP); Suguru Masunaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/813,835

(22) PCT Filed: Jul. 25, 2011

(86) PCT No.: PCT/JP2011/067564

§ 371 (c)(1),
(2), (4) Date: Feb. 1, 2013

(87) PCT Pub. No.: WO2012/023416

PCT Pub. Date: Feb. 23, 2012

(65) Prior Publication Data

US 2013/0135368 A1 May 30, 2013

(30) Foreign Application Priority Data

Aug. 18, 2010 (JP) ..... 2010-182734

(51) Int. Cl.
*B41J 2/175* (2006.01)

(52) U.S. Cl.
USPC ..... 347/87; 347/6; 347/7

(58) Field of Classification Search
USPC ..... 347/7, 9, 14, 87, 5, 6, 19
See application file for complete search history.

(56) References Cited

U.S. PATENT DOCUMENTS

| | | | |
|---|---|---|---|
| 6,137,503 | A | 10/2000 | Hashimoto et al. |
| 6,378,971 | B1 | 4/2002 | Tamura et al. |
| 2007/0040877 | A1 | 2/2007 | Kachi |
| 2007/0109362 | A1 | 5/2007 | Hori et al. |

(Continued)

FOREIGN PATENT DOCUMENTS

| | | |
|---|---|---|
| CN | 102791490 | 11/2012 |
| EP | 0626267 A2 | 11/1994 |

(Continued)

OTHER PUBLICATIONS

International Search Report Issued Oct. 25, 2011 in PCT/JP2011/067564 Filed on Jul. 25, 2011.

(Continued)

*Primary Examiner* — Lam S Nguyen
(74) *Attorney, Agent, or Firm* — Cooper & Dunham LLP

(57) ABSTRACT

In an image forming apparatus, a first detection part and a second detection part, each for detecting a position of a displacement member that changes its position according to a remaining amount of liquid in a sub-tank, are provided to a carriage carrying the sub-tank and a recording head, and a body of the image forming apparatus, respectively. A first position is a position of the displacement member detected by the first detection part such that the remaining amount of liquid in the sub-tank is smaller than that at a second position detected by the second detection part. The liquid is supplied to the sub-tank of a differential supply amount, corresponding to a displacement amount of the displacement member between a position detected by the first detection part and a position detected by the second detection part, after the first detection part detects the displacement member.

15 Claims, 25 Drawing Sheets

(56) References Cited

U.S. PATENT DOCUMENTS

| | | | | |
|---|---|---|---|---|
| 2008/0079790 | A1* | 4/2008 | Kachi | 347/87 |
| 2009/0122122 | A1 | 5/2009 | Kubo et al. | |
| 2009/0184991 | A1 | 7/2009 | Sugahara | |
| 2010/0321426 | A1 | 12/2010 | Suzuki et al. | |
| 2011/0164077 | A1 | 7/2011 | Masunaga | |

FOREIGN PATENT DOCUMENTS

| | | | |
|---|---|---|---|
| EP | 1097814 | A2 | 5/2001 |
| EP | 2067622 | A1 | 6/2009 |
| JP | 2001-162834 | | 6/2001 |
| JP | 3219326 | | 10/2001 |
| JP | 2007-15153 | | 1/2007 |
| JP | 2007-130979 | | 5/2007 |
| JP | 2007-136807 | | 6/2007 |
| JP | 2008-132638 | | 6/2008 |
| JP | 4155879 | | 9/2008 |
| JP | 2008-265125 | | 11/2008 |
| JP | 4190001 | | 12/2008 |
| JP | 2009-23092 | | 2/2009 |
| JP | 2009-23329 | | 2/2009 |
| JP | 2009-126049 | | 6/2009 |
| JP | 4298474 | | 7/2009 |
| JP | 2009-274325 | | 11/2009 |

OTHER PUBLICATIONS

European Search Report dated Aug. 5, 2013 in corresponding European patent application No. 11 81 8058.7.
Chinese official action dated Aug. 4, 2014 in corresponding Chinese patent application No. 2011 80 03 9238.X.

* cited by examiner

MOVE CARRIAGE

IMAGE FORMING APPARATUS

TECHNICAL FIELD

The present invention relates to an image forming apparatus, and in particular, to an image forming apparatus including a recording head that discharges liquid droplets and a sub-tank that supplies liquid to the recording head.

BACKGROUND ART

As an image forming apparatus such as a printer, a facsimile machine, a copier, a plotter, or a multi-function peripheral in which some functions of a printer, a facsimile machine, a copier, a plotter, and so forth, are combined, an ink jet recording apparatus or such, for example, is known as an image forming apparatus of a liquid discharge recording type using a recording head configured as a liquid discharge head (or liquid droplet discharge head) that discharges ink droplets. In the image forming apparatus of the liquid discharge recording type, ink droplets are discharged by a recording head to a sheet of paper that has been conveyed, and an image is formed on the sheet of paper. The sheet of paper that has been thus conveyed may include not only paper but also an OHP (Over Head Projector) sheet or such, and any thing capable of liquid being adhered thereto, and may also be referred to as a recording medium, recording paper, or such. Forming an image may also be referred to as recording, printing and so forth. The image forming apparatuses of liquid discharge recording type include a serial-type image forming apparatus and a line-type image forming apparatus. The serial-type image forming apparatus is such that a recording head moving in main scan direction discharges liquid droplets and forms an image. The line-type image forming apparatus is such that a line type recording head is used where the recording head not moving discharges liquid droplets and forms an image.

It is noted that in the present patent application, the "image forming apparatus" of liquid discharge recording type means an apparatus that discharges liquid to a medium such as paper, thread, fiber, cloth, leather, metal, plastic, glass, wood, ceramics or such. "Forming an image" means not only giving to a medium an image that has a meaning such as a letter, a figure or such, but also giving to a medium an image that does not have a meaning such as a pattern or such (also merely causing a liquid droplet to land on a medium). "Ink" means not only one called "ink" but is used as a general term of any thing that is capable of being used to form an image and may be referred to as recording liquid, fixing solution, liquid or such. For example, a DNA sample, resist, pattern material, resin, and so forth, are included in "ink". Further, an "image" is not only a planar image but also an image given to a thing that has been formed three-dimensionally, or a statue or such formed as a result of a shape being molded three-dimensionally.

As such an image forming apparatus, one is known in which a sub-tank (also referred to as a head tank, a buffer tank or such) is provided for supplying ink to a recording head, and the ink is supplied to the sub-tank from a main tank (also referred to as an ink cartridge) which is detachably loaded in a body of the image forming apparatus.

As such an image forming apparatus, one is known in which a sub-tank (also referred to as a head tank, a buffer tank or such) may have a negative pressure creating function (mechanism) that creates negative pressure for the purpose of preventing ink from seeping or dripping from nozzles of a recording head. The sub-tank has a flexible member (film member) used as one side of an ink container that contains ink, and a negative pressure creating part that includes a resilient member that gives such force to the flexible member to cause it to move outward. Further, an atmosphere opening mechanism is provided that is capable of being opened and closed, and opens the inside of the ink container to the atmosphere. In this configuration, ink is supplied to the recording head from the ink container.

The sub-tank is provided with a displacement member (also referred to as a detection member or a detection filler) which changes a position itself as a position of the flexible member changes. When an atmosphere opening filling process is to be carried out where the atmosphere opening mechanism of the sub-tank is opened and the ink is supplied from the main tank to the sub-tank, a carriage that carries the recording head and the sub-tank is moved to a predetermined detection position (i.e., a fully filling up detection position), and the sub-tank is opened to the atmosphere as a result of a driving part of the atmosphere opening mechanism being operated. In this state, supplying ink to the sub-tank is carried out in a state where the carriage has been moved to the predetermined carriage position. Then, when the displacement member is detected by a detection part of the image forming apparatus, it is determined that the sub-tank has been fully filled up (see the following Patent Documents 1-9).

Patent Document 1: Japanese Patent No. 4298474;
Patent Document 2: Japanese Patent No. 4190001;
Patent Document 3: Japanese Patent No. 4155879;
Patent Document 4: Japanese Laid-open Patent Application No. 2007-015153;
Patent Document 5: Japanese Laid-open Patent Application No. 2007-130979;
Patent Document 6: Japanese Laid-open Patent Application No. 2008-132638;
Patent Document 7: Japanese Laid-open Patent Application No. 2009-023329;
Patent Document 8: Japanese Laid-open Patent Application No. 2009-274325;
Patent Document 9: Japanese Laid-open Patent Application No. 2009-023092

In this case, in order to make it possible to supplementarily supply the ink even during printing operations, the following control may be carried out (see Patent Document 9). That is, when an ink consumption amount is equal to or more than a first predetermined value, the following operation is carried out. Based on information correlating to an ink supply amount having been supplied to the sub-tank from the main tank during printing, ink supply from the main tank to the sub-tank is carried out when the ink supply amount is equal to or less than a second predetermined amount. Ink supply from the main tank to the sub-tank is not carried out when the ink supply amount exceeds the second predetermined amount.

It is noted that ink supply to the sub-tank may be carried out even during printing operation by providing an ink remaining amount detection part to the sub-tank instead of the above-described configuration of the sub-tank (see the following Patent Document 10).

Patent Document 10: Japanese Patent No. 3219326

In the above-mentioned case where the displacement member that changes the position according to the ink remaining amount in the sub-tank is provided to the sub-tank while fully filling up of the sub-tank is detected by the body of the image forming apparatus, the carriage is to be moved to the predetermined fully filling up position when ink supply is to be carried out from the main tank to the sub-tank. Therefore, it is necessary to interrupt printing operations in order to carry out an ink supply operation when the ink remaining amount in the sub-tank is lowered during the printing operations. Thus, a printing speed may be lowered.

In this case, it may be possible to calculate an ink consumption amount in the sub-tank by counting the number of discharge droplets or so, and ink supply from the main tank to the sub-tank may be carried out by a supply amount corresponding to the calculated ink consumption amount. However, in this method, since detection of ink fully filling up of the sub-tank is carried out not so precisely, excessive negative pressure in the sub-tank due to shortage of ink supply or insufficient negative pressure due to excess of ink supply may occur. In order to avoid such a situation, it is necessary to periodically carry out the atmosphere opening filling process after moving the carriage to the fully filling up detection position. Thus, a printing operation is to be interrupted, and a printing speed may be lowered.

Further, it may be possible to provide to the carriage a part to detect an ink remaining amount in the sub-tank and, a part to drive the atmosphere opening mechanism, and provide to the carriage necessary members and parts to control ink supply to the sub-tank. However, in this method, the carriage may becomes heavy, a size of the carriage may be increased, and thus, a size of the image forming apparatus may be increased.

SUMMARY OF INVENTION

According to an embodiment of the present invention, an image forming apparatus includes a recording head configured to discharge liquid droplets; a sub-tank configured to contain liquid to be supplied to the recording head; a carriage configured to carry the recording head and the sub-tank; a main tank configured to contain the liquid to be supplied to the sub-tank; and a liquid feeding part configured to supply the liquid from the main tank to the sub-tank. The sub-tank includes a displacement member configured to change a position of the displacement member according to a liquid remaining amount in the sub-tank. A first detection part configured to detect that the displacement member comes at a predetermined first position is provided to the carriage. A second detection part configured to detect that the displacement member comes at a predetermined second position is provided to a body of the image forming apparatus. The first position corresponds to a liquid remaining amount in the sub-tank smaller than a liquid remaining amount in the sub-tank which the predetermined second position corresponds to. A differential supply amount corresponding to a displacement amount of the displacement member between a position of the displacement member detected by the first detection part and a position of the displacement member detected by the second detection part is detected and stored. Then, when the liquid is supplied to the sub-tank from the main tank without using the second detection part, the differential supply amount of the liquid is supplied to the sub-tank after the first detection part detects the displacement member.

According to another embodiment of the present invention, an image forming apparatus includes a recording head configured to discharge liquid droplets; a sub-tank configured to contain liquid to be supplied to the recording head; a carriage configured to carry the recording head and the sub-tank; a main tank configured to contain the liquid to be supplied to the sub-tank; and a liquid feeding part configured to supply the liquid from the main tank to the sub-tank. The sub-tank includes a displacement member configured to change a position of the displacement member according to a liquid remaining amount in the sub-tank. A detection part configured to detect at least two or more detection regions of the displacement member is provided to the carriage. Liquid supply to the sub-tank is controlled in such a manner that the displacement member moves between a position at which the detection part detects one of the at least two or more detection regions of the displacement member and another position at which the detection part detects another of the at least two or more detection regions of the displacement member.

Other objects, features and advantages of embodiments the present invention will become more apparent from the following detailed description when read in conjunction with the accompanying drawings.

BRIEF DESCRIPTION OF DRAWINGS

(FIG. 24A shows a fully filling up position and FIG. 24B shows a first sensor detection position);

(FIG. 29A shows a first range (a), FIG. 29B shows a second range (b) and FIG. 29C shows a third range (c)).

DESCRIPTION OF EMBODIMENTS

According to embodiments of the present invention, it is possible to fully fill up a sub-tank with liquid during printing operations, when a configuration is provided such that a detection part provided to a body of an image forming apparatus detects a displacement member that changes its position according to a remaining amount of the liquid in the sub-tank and thus detection of fully filling up of the sub-tank is carried out. Thus, according to the embodiments of the present invention, it is possible to supply an appropriate amount of the liquid from a main tank to the sub-tank even while a carriage carrying the sub-tank is moving.

Figure 1:
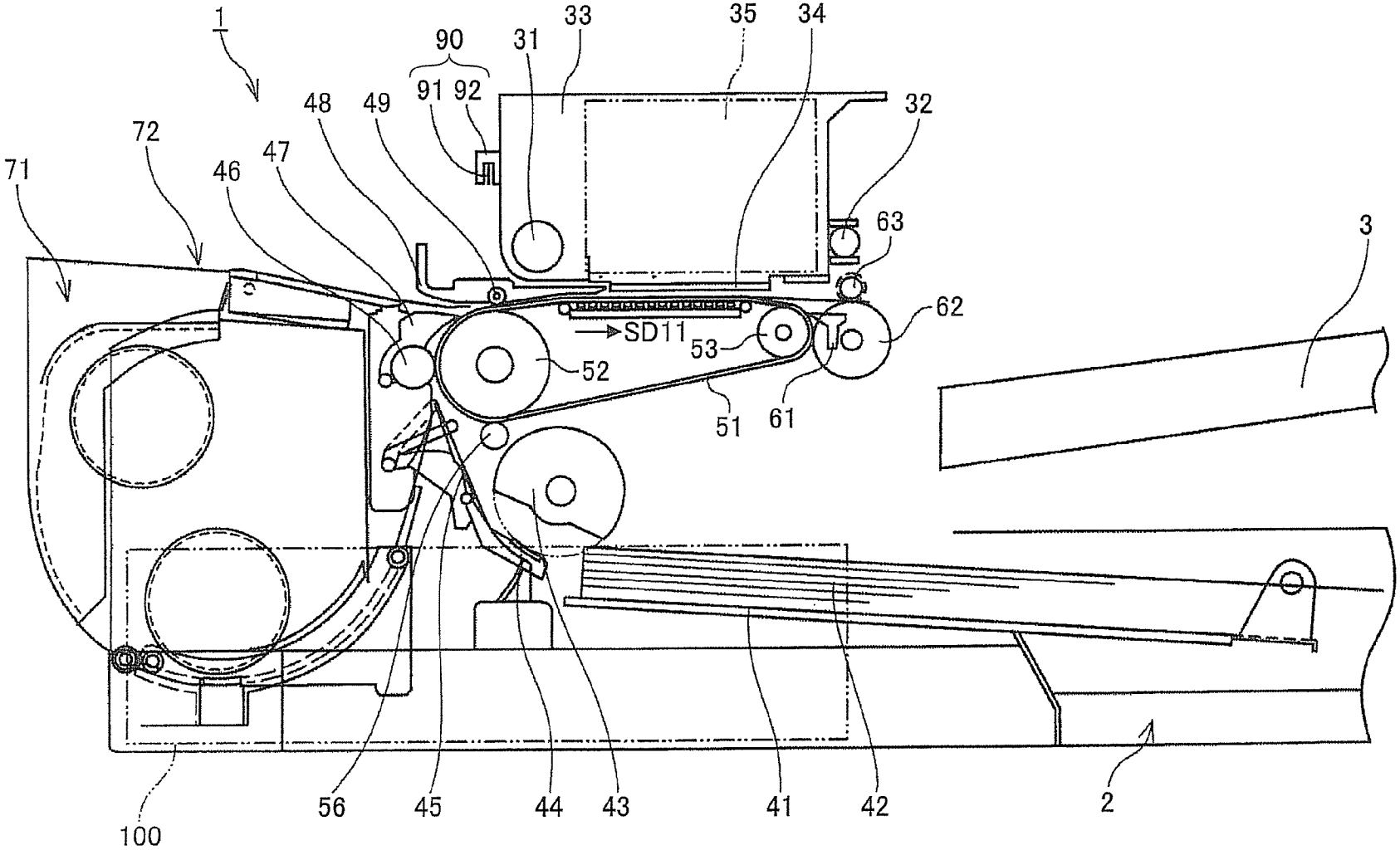
FIG. 1 is a side view showing a general configuration of a mechanism part of an image forming apparatus for illustrating a first embodiment of the present invention.
Figure 2:
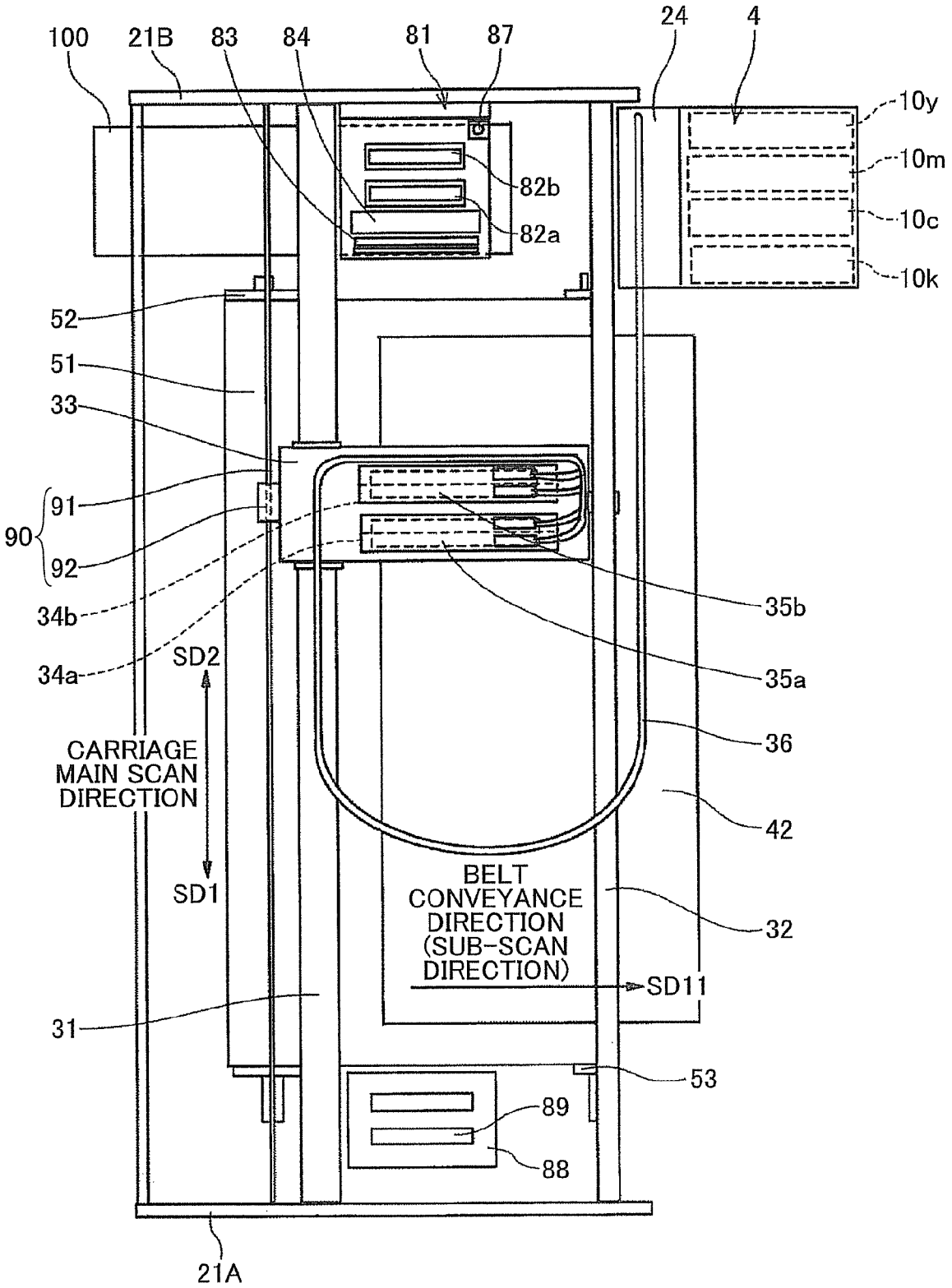
FIG. 2 is a plan view partially showing the mechanism part.

Below, the embodiments of the present invention will be described with reference to figures. First, one example of an image forming apparatus according to an embodiment of the present invention will be described with reference to FIGS. 1 and 2. It is noted that FIG. 1 is a side view of the image forming apparatus for illustrating the whole configuration of the image forming apparatus. FIG. 2 partially shows a plan view of the image forming apparatus.

The image forming apparatus is a serial-type ink-jet recording apparatus. In the image forming apparatus, main and auxiliary guide rods 31 and 32 as guide members are horizontally provided between right and left side plates 21A and 21B of a body of the image forming apparatus 1, and support a carriage 33 in such a manner that the carriage 33 is allowed to slide in main scan directions SD1, SD2. The carriage 33 carries out moving and scanning operations in the main scan directions SD1, SD2 by means of a main scan motor (described later) via a timing belt (not shown).

On the carriage 33, recording heads 34*a* and 34*b* (which may be generally referred to as "recording heads 34") are arranged in a sub-scan direction SD11 that is perpendicular to the main scan directions SD1, SD2. The recording heads 34 include liquid discharge heads that discharge ink droplets of respective colors of yellow (Y), cyan (C), magenta (M) and black (K). In the recording heads 34, nozzle rows are disposed along the sub-scan direction SD11, and the recording heads 34 are mounted on the carriage 33 in such a manner that ink droplet discharge directions of the nozzles face downward.

Each of the recording heads 34 has two nozzle rows. One of the two nozzle rows of the recording head 34*a* discharges black (K) droplets, and the other of the two nozzle rows discharges cyan (C) droplets. Similarly, one of the two nozzle rows of the recording head 34*b* discharges magenta (M) droplets, and the other of the two nozzle rows discharges yellow (Y) droplets.

Further, sub-tanks 35*a* and 35*b* (which may be generally referred to as "sub-tanks 35") for supplying the ink of the respective colors to the corresponding nozzle rows of the recording heads 34 are mounted on the carriage 33. Recording liquid (i.e., the ink) of the respective colors is complementarily supplied, by means of a supply pump unit 24 via tubes 36 of the respective colors, to the recording heads 35 from ink cartridges 10*y*, 10*m*, 10*c* and 10*k* (which may be generally referred to as cartridges 10) which are main tanks for the respective colors. The ink cartridges 10*y*, 10*m*, 10*c* and 10*k* are detachably loaded in a cartridge loading part 4.

Further, an encoder scale 91 of a linear encoder 90 is disposed along the main scan directions SD1, SD2 of the carriage 33, and an encoder sensor 92 of the linear encoder 90 which reads the encoder scale 91 is provided to the carriage 33. By using a detection signal of the linear encoder 90, a position (carriage position) and a moving amount of the carriage 33 (i.e., a carriage moving amount) in the main scan directions SD1, SD2 are detected.

As a paper feeding part for feeding sheets of paper 42 that are stacked on a paper stacking part (pressure plate) 41 of a paper feeding tray 2, a semicircular roller (paper feeding roller) 43 that feeds the sheets of paper 42, sheet by sheet, from the paper stacking part 41, and a separation pad 44 that faces the paper feeding roller 43 and is made of a material having a high coefficient of friction, are provided. The separation pad 44 is pressed onto the paper feeding roller 43.

In order to feed the sheet of paper 42 fed from the paper feeding part to under the recording heads 34, a guide member 45 that guides the sheet of paper 42, a counter roller 46, a conveyance guide member 47 and a pressing member 48 having an extending-end pressing roller 49 are provided. Further, a conveyance belt 51 as a conveyance part is provided for electrostatically attracting the fed sheet of paper 42 and conveying it to a position facing the recording heads 34.

The conveyance belt 51 is an endless belt, is wound on a conveyance roller 52 and a tension roller 53, and is rotated in a belt conveyance direction (sub-scan direction SD11). Further, an electrification roller 56 as an electrification part is provided to electrify a surface of the conveyance belt 51. The electrification roller 56 is disposed to come into contact with a surface layer of the conveyance belt 51, and is rotated as a result of being driven by the conveyance belt 51. The conveyance belt 51 is rotated in the belt conveyance direction as a result of being driven by a sub-scan motor (described later) via a timing belt (not shown).

As a paper ejection part for ejecting the sheet of paper 42 on which recording has been carried out by the recording heads 34, a separation claw 61 for separating the sheet of paper 42 from the conveyance belt 51 and a spur 63 that is a paper ejection roller are provided. Further, a paper ejection tray 3 is provided below the paper ejection roller 62.

Further, a both-sides unit 71 is detachably provided on a back side of the body of the image forming apparatus 1. The both-sides unit 71 takes the sheet of paper 42 that has been returned by a reverse rotation of the conveyance belt 51, turns the sheet of paper 42 over, and again feeds the sheet of paper 42 to between the counter roller 46 and the conveyance belt 51. Further, a top surface of the both-sides unit 71 is used as a manual paper feeding tray 72.

Further, in a non-printing area on one side in the scan direction SD2 of the carriage 33, a maintenance and recovery mechanism 81 is provided for maintaining and recovering states of the nozzles of the recording heads 34. The maintenance and recovery mechanism 81 includes cap members (referred to as caps, hereinafter) 82*a*, 82*b* (which may be generally referred to as "caps 82"), a wiper member (wiper blade) 83, a dummy discharge receiver 84, a carriage lock 87, and so forth. The caps 82 are used to cap the respective nozzle faces of the recording heads 34. The wiper member 83 is used to wipe the nozzle faces. The dummy discharge receiver 84 receives liquid droplets (ink droplets) when dummy discharge of discharging recording liquid (ink) that is not actually used for recording, which is carried out for the purpose of discharging the recording liquid having increased viscosity, is carried out. The carriage lock 87 is used to lock the carriage 33. Below the maintenance and recovery mechanism 81, a waste liquid tank 100 is replaceably provided to the body of the image forming apparatus 1 for holding waste liquid that is produced through the maintenance and recovery operation.

Further, in a non-printing area on the other side in the scan direction SD1 of the carriage 33, a dummy discharge receiver 88 is disposed which receives liquid droplets (ink droplets) when dummy discharge of discharging recording liquid (ink) that is not actually used for recording, which is carried out for the purpose of discharging the recording liquid having increased viscosity, is carried out during recording or so. The dummy discharge receiver 88 includes an opening part 89 provided along the direction along which the nozzle rows of the recording heads 34 are arranged.

In the image forming apparatus 1 configured as described above, the sheets of paper 42 are fed from the paper feeding tray 2, sheet by sheet, as a result of being separated from the other sheets. Then, the sheet of paper 42 that has been thus fed upward approximately vertically is guided by the guide member 45, is sandwiched between and conveyed by the conveyance belt 51 and the counter roller 46, and the leading end of the sheet of paper 42 is further guided by the conveyance guide 37, is pressed onto the conveyance belt 51 by the extending-end pressing roller 49, and thus, the conveyance direction of the sheet of paper 42 is changed by approximately 90°.

At this time, AC voltages of plus output and minus output being alternately repeated are applied to the electrification roller 56, and as a result, the conveyance belt is electrified by an alternating electrification voltage pattern. That is, along the sub-scan direction SD11, i.e., the rotating direction, the conveyance belt 51 is electrified in such a manner that plus and minus changes are alternately repeated in respective strip-like areas at predetermined widths. When the sheet of paper 42 is fed onto the conveyance belt 51 that is thus electrified alternately between plus and minus changes, the sheet of paper 42 is attracted by the conveyance belt 51, and is conveyed in the sub-scan direction SD11 as the conveyance belt 51 is rotated.

By driving the recording heads 34 according to an image signal while the carriage 33 is being moved, a line of an image is recorded onto the sheet of paper 42, which is stopped, as a result of ink droplets being discharged thereto. Then, after the sheet of paper 42 is conveyed by a predetermined amount, the next line of image is recorded onto the sheet of paper 42. When a recording finish signal or a signal indicating that the tail end of the sheet of paper 42 has reached a recording area is generated, the recording operation is finished, and the sheet of paper 42 is ejected to the paper ejection tray 3.

When the maintenance and recovery of the nozzles of the recording heads 34 is to be carried out, the carriage 33 is moved to a position facing the maintenance and recovery mechanism 81, i.e., a home position. Then, the maintenance and recovery operation is carried out where a nozzle suctioning operation in which the caps 82 cap the nozzles and the ink is suctioned from the nozzles, the dummy discharge operation of discharging the liquid droplets (ink droplets) that are not actually used for image forming, and so forth, are carried out. Thus, it is possible to stably carry out image forming by discharging liquid droplets.

Figure 3:
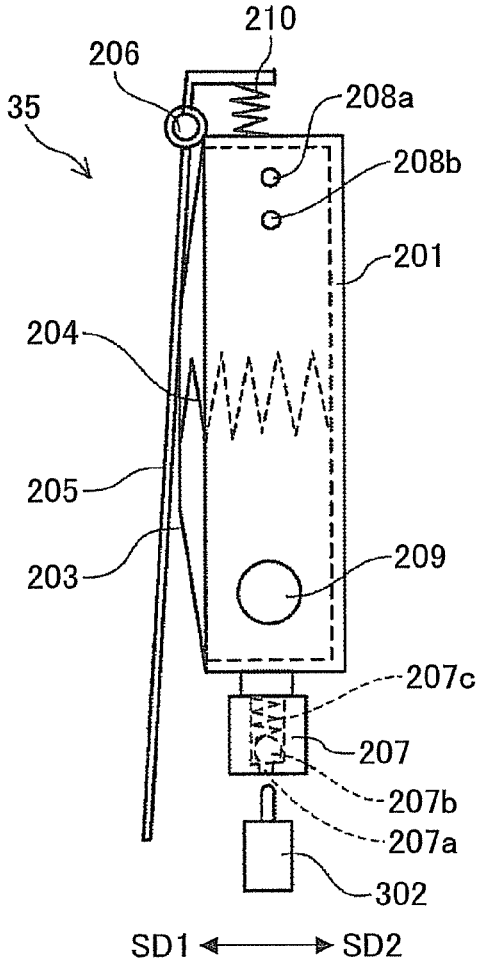
FIG. 3 is a schematic plan view showing one example of a sub-tank.
Figure 4:
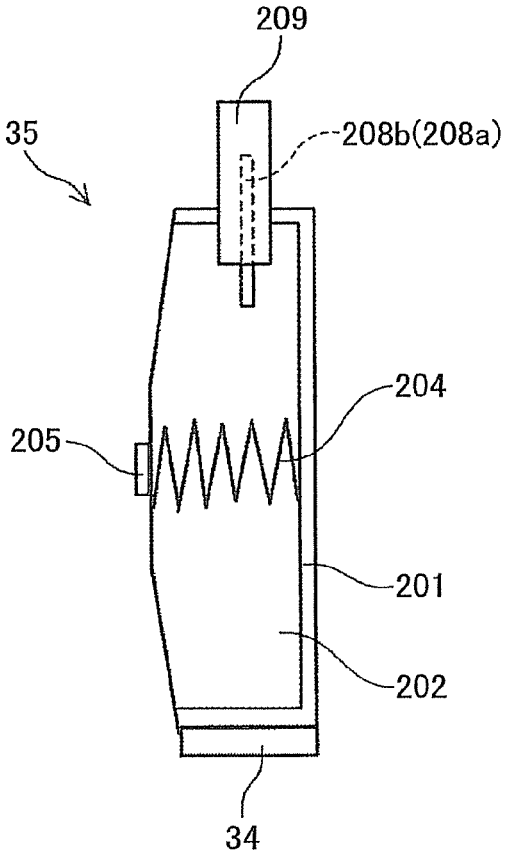
FIG. 4 is a schematic front sectional view showing the sub-tank of FIG. 3.

Next, with reference to FIGS. 3 and 4, one example of the sub-tank 35 will be described. It is noted that FIG. 3 schematically shows a plan view of the sub-tank 35 for one nozzle row, and FIG. 4 schematically shows a front view of the sub-tank 35 for one nozzle row.

The sub-tank 35 has a tank case 201, acting as an ink holding part, for holding ink, and the tank case 201 has an opening on one side part. The opening of the tank case 201 is closed tightly by a flexible film 203 that is a flexible member, and thus, the ink holding part is formed. The flexible film 203 is pressed outward at any time by a spring 204 that is a resilient member disposed in the inside of the tank case 201. Thus, a pressing force is given to the flexible film 203 of the tank case 201 outward by the spring 204, and negative pressure is generated when an ink remaining amount in the ink holding part 202 of the tank case 201 decreases.

Further, a displacement member made of a filler (hereinafter, may be simply referred to as a "filler") 205 is fixed by adhesive or such onto the flexible film 203 on the outside of the tank case 201. A part of the displacement member 205 near one end of the displacement member 205 is supported by a supporting shaft 206 so that the filler 205 is rotatable around the one end, and is pressed by a spring 210 toward the tank case 201. Thus, the position of the displacement member 205 is changed as the flexible film 203 moves in an interlocked manner. As a result of the displacement member 205 being detected by a second detection part (second sensor) 301 (described later) provided to the carriage 33 or a first detection part (first sensor) 251 (described later) provided to the body of the image forming apparatus 1, the ink remaining amount or the negative pressure in the sub-tank 25 can be detected.

Further, at an upper part of the tank case 201, a supply port 209 is provided for supplying the ink to the tank case 201 from the ink cartridge 10, and is connected to the ink supply tube 36 (see FIG. 2). Further, an atmosphere opening mechanism 207 is provided to a side part of the tank case 201. The atmosphere opening mechanism 207 allows the inside of the sub-tank 35 to communicate with the atmosphere. The atmosphere opening mechanism 207 includes a valve body 207*b* that opens and closes an atmosphere opening passage 207*a* that allows the inside of the sub-tank 35 to communicate with the atmosphere, a spring 207*c* that presses the valve body 207*b* to cause the valve body 207*b* to block the atmosphere opening passage 207*a*, and so forth. As a result of the valve body 207*b* being pressed by an atmosphere opening solenoid 302 provided to the body of the image forming apparatus 1, the value body 207*b* is caused to open the atmosphere opening passage 207*a*, and thus, the sub-tank 35 enters an atmosphere opened state where the inside of the sub-tank 35 communicates with the atmosphere.

Further, electrode pins 208*a* and 208*b* are provided for detecting an ink level in the sub-tank 35. The ink has electric conductivity, and therefore, when the ink has reached to a position of the electrode pins 208*a* and 208*b*, an electric current flows between the electrode pins 208*a* and 208*b*, and thus, a resistance value between the electrode pins 208*a* and 208*b* changes. Thus, it is possible to detect that the ink level in the sub-tank 35 becomes equal to or less than a predetermined height, i.e., an air amount in the sub-tank becomes equal to or more than a predetermined amount.

Figure 5:
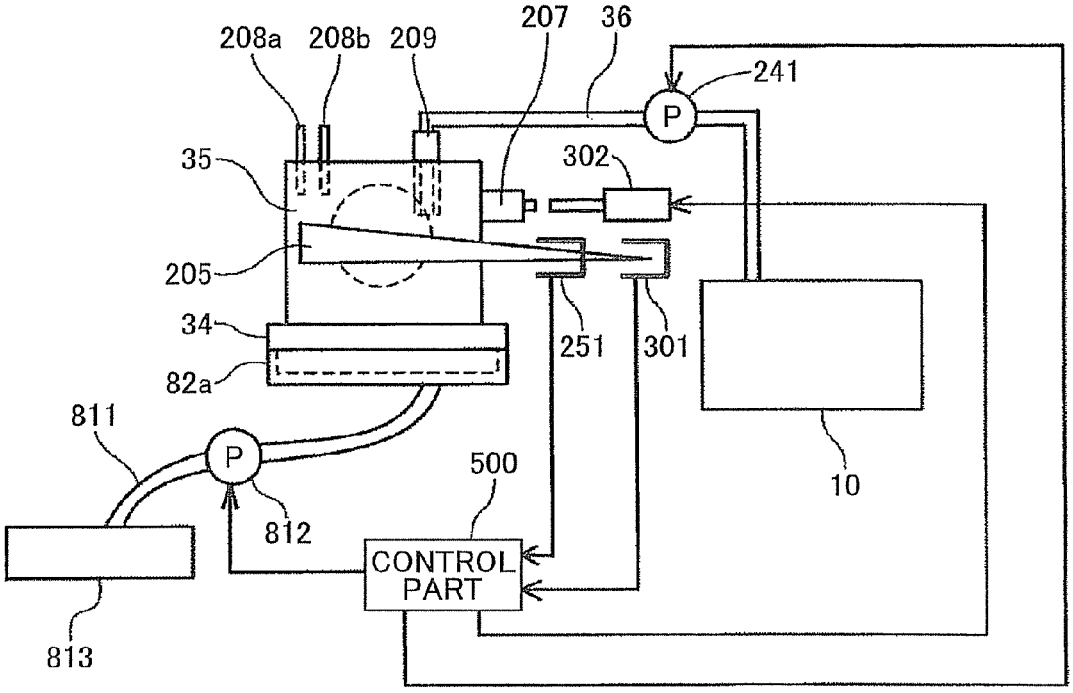
FIG. 5 is a schematic view illustrating an ink supply and discharge system.

Next, an ink supply and discharge system in the image forming apparatus 1 will be described with reference to FIG. 5. First, supplying the ink from the cartridge (hereinafter, referred to as the main tank) 10 to the sub-tank 35 is carried out by a liquid feeding pump 241 that is a liquid feeding part of a supply pump unit 24 via the ink supply tube 36 (see FIG. 2). It is noted that the liquid feeding pump 241 is a pump capable of feeding liquid in both directions such as a tube pump, and thus, is capable of carrying out both an operation of supplying the ink from the main tank 10 to the sub-tank 35 and an operation of returning the ink from the sub-tank 35 to the main tank 10.

As described above, the maintenance and recovery mechanism 81 has the (suction) caps 82*a* and a suction pump 812 connected with the suction caps 82*a*. Then, as a result of the suction pump 812 being driven in a condition where the suction caps 82*a* cap the nozzle faces, the ink is suctioned from the nozzles via a suction tube 811. Thus, it is possible to suction the ink from the inside of the sub-tank 35. It is noted that the waste ink thus suctioned is discharged to a waste liquid tank 813.

Further, to the body of the image forming apparatus 1, the atmosphere opening solenoid 302 is provided which is a pressing member for opening and closing the atmosphere opening mechanism 207 of the sub-tank 35. As a result of the atmosphere opening solenoid 302 being operated, it is possible to open the atmosphere opening mechanism 207.

Further, the first sensor 251 made of an optical sensor acting as the first detection part that detects the displacement member 205 is provided to the carriage 33. The second sensor 301 made of an optical sensor that detects the displacement member 205 is provided to the body of the image forming apparatus 1. As described later, an operation of supplying the ink to the sub-tank 35 is controlled by using detection results of the first and second sensors 251 and 301.

It is noted that a control part 500 included in the image forming apparatus 1 carries out driving and controlling the above-mentioned liquid feeding pump 241, the atmosphere opening solenoid 302 and the suction pump 812, and carries out an operation of supplying the ink to the sub-tank 35.

Figure 6:
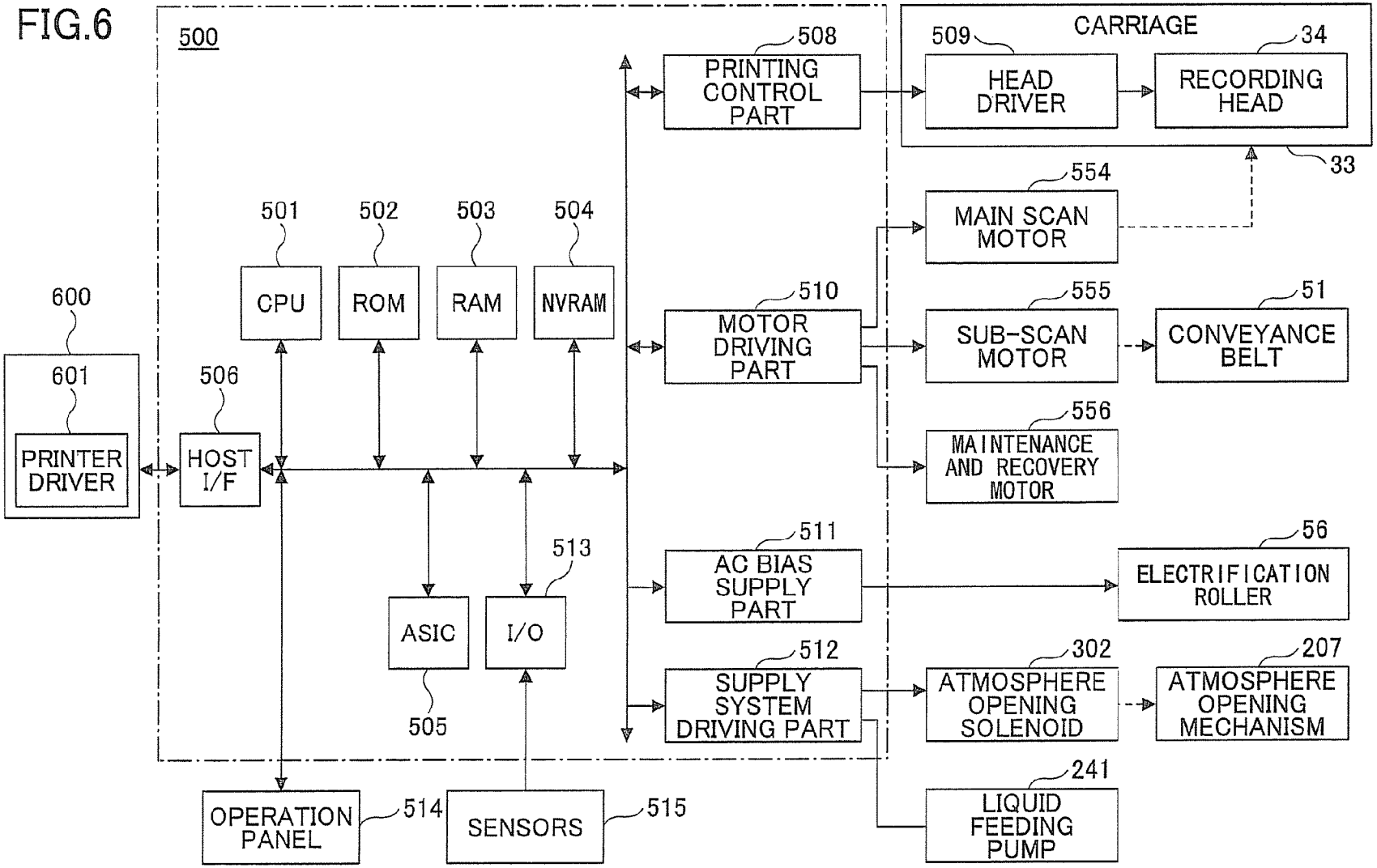
FIG. 6 is a block diagram generally illustrating a control part.

Next, the control part 500 will be generally described with reference to FIG. 6. It is noted that FIG. 6 is a block diagram and illustrates the entirety of the control part 500.

The control part 500 carries out control of the entirety of the image forming apparatus 1, and includes a CPU (Central Processing Unit) 501, a ROM (Read Only Memory) 502, a RAM (Random Access Memory) 503, a rewriteable non-volatile memory 504 and an ASIC (Application Specific Integrated Circuit) 505. The ROM 502 stores a program executed by the CPU 501, and fixed data. The RAM 503 temporarily stores image data or such. The rewriteable non-volatile memory 504 holds data even after power supply to the image forming apparatus 1 is turned off. The ASIC 505 carries out various sorts of signal processing, image processing such as sorting, and processes input/output signals for controlling the entirety of the image forming apparatus 1.

Further, the control part 500 includes a printing control part 508, a head driver (driver IC (Integrated Circuit)) 509, a motor driving part 510, an AC (Alternating Current) bias supply part 511 and a supply system driving part 512. The printing control part 508 includes a data transfer part and a driving signal generation part for driving and controlling the recording heads 34. The head driver 509 drives the recording heads 34 provided to the carriage 33. The motor driving part 510 drives the main scan motor 554 that moves the carriage 33 and causes the carriage 33 to carry out scanning operations, the sub-scan motor 555 that rotates the conveyance belt 51 and a maintenance and recovery motor 556 of the maintenance and recovery mechanisms 81. The AC bias supply part 511 supplies an AC bias to the electrification roller 56. The supply system driving part 512 drives the atmosphere opening solenoid 302 that is provided to the body of the image forming apparatus 1 and opens and closes the atmosphere opening mechanism 207 of the sub-tank 35, and drives the liquid feeding pump 241.

Further, an operations panel 514 for the user to input necessary information to the image forming apparatus 1 and displaying information to the user is connected to the control part 500.

The control part 500 has a I/F (Interface) 506 for transmitting and receiving data and a signal to and from a host apparatus 600. The image forming apparatus 1 receives data or a signal, via the I/F 506, from the host apparatus 600 such as an information processing apparatus such as a personal computer, an image reading apparatus such as an image scanner, or an image pickup apparatus such as a digital camera, via a cable or a communication network.

The CPU 501 of the control part 500 reads and analyzes printing data stored in a receiving buffer (not shown) included in the I/F 506, carries out necessary image processing, sorting data, or such, by using the ASIC 505, and transfers the image data to the head driver 509 from the printing control part 508. It is noted that generation of dot pattern data for outputting an image is carried out by a printer driver 601 included in the host apparatus 600.

The printing control part 508 transfers the above-mentioned image data as serial data, and outputs a transfer clock signal and a latch signal necessary for transferring the data and fixing the transfer, a control signal, and so forth, to the head driver 509. Further, the printing control part 508 includes a driving signal generation part (not shown) that includes a D-A (Digital to Analog) converter carrying out D-A converting of pattern data of driving pulses stored in the ROM 502, a voltage amplifier, a current amplifier and so forth. Thus, the printing control part 508 outputs to the head driver 509 the driving signal including one or plural the driving pulses.

The head driver 509 drives the recording heads 34 by selectively applying the driving pulses of the driving signal given by the printing control part 508 based on the serially input image data corresponding to the recording heads 34 for one line to driving elements (for example, piezoelectric elements) that generate energy for causing the recording heads 34 to discharge liquid droplets (ink droplets). At this time, by selecting the driving pulse of the driving signal, it is possible to distinguishingly discharge dots having different sizes such as a large droplet, a medium droplet, a small droplet, and so forth, for example.

An I/O (Output and Input) part 513 obtains information from a group of various sorts of sensors 515 loaded in the image forming apparatus 1, extracts therefrom necessary information for controlling the image forming apparatus 1, and uses the extracted information for controlling the printing control part 508, the motor control part 510 and the AC bias supply part 511, for supplying the ink to the sub-tanks 35, and so forth.

The group of various sorts of sensors 515 includes the above-mentioned first sensor 251, the second sensor 301, the electrode pins 208*a*, 208*b*, an optical sensor for detecting a position of a sheet of paper 42, thermistors for monitoring temperature and humidity in the image forming apparatus 1 (including an environmental temperature sensor and an environmental humidity sensor), a sensor for monitoring the voltage of the electrification roller 56, an interlock switch for detecting an open/closed state of a cover of the image forming apparatus 1, and so forth. The I/O part 513 is capable of processing various sorts of sensor information.

Next, with reference to FIGS. 7A and 7B, an operation of creating negative pressure (negative pressure creating operation) in the sub-tank 35 in the image forming apparatus 1 configured as described above will be described.

Figure 7A:
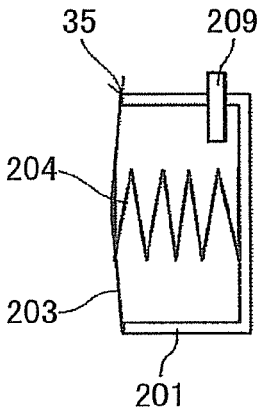
FIGS. 7A and 7B illustrate a negative pressure creating operation for the sub-tank.
Figure 7B:
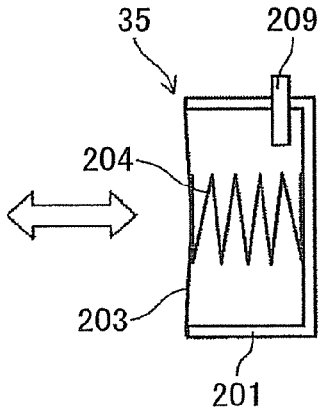

As shown in FIG. 7A, after the ink is supplied to the sub-tank 35 from the main tank 10, the ink is suctioned from the sub-tank 35 as described above, or the recording head 34 is driven and is caused to carry out discharging liquid droplets (discharging liquid droplets not actually used for image forming, or dummy discharge). Thus, the ink amount in the sub-tank 35 is reduced. Thus, as shown in FIG. 7B, such force is generated to change the position of the flexible film 203 toward the inside of the sub-tank 35 against the resilient force of the spring 204. Thereby, negative pressure is created in the inside of the sub-tank 35 due to the resilient force of the spring 204.

Further the liquid feeding pump 241 is used to suction the ink from the sub-tank 35, and thereby, the flexible film 203 is drawn to the inside of the sub-tank 35. Thus, the spring 204 is further compressed, and as a result, the negative pressure is further increased (becomes stronger).

When the ink is supplied to the sub-tank 35 in this state, the flexible film 203 is pressed toward the outside of the sub-tank 35, thus the spring 204 expands, and the negative pressure is reduced (becomes weaker).

By repeating these operations, it is possible to carry out control to maintain the negative pressure in the inside of the sub-tank 35 to fall within a fixed range.

Figure 8:
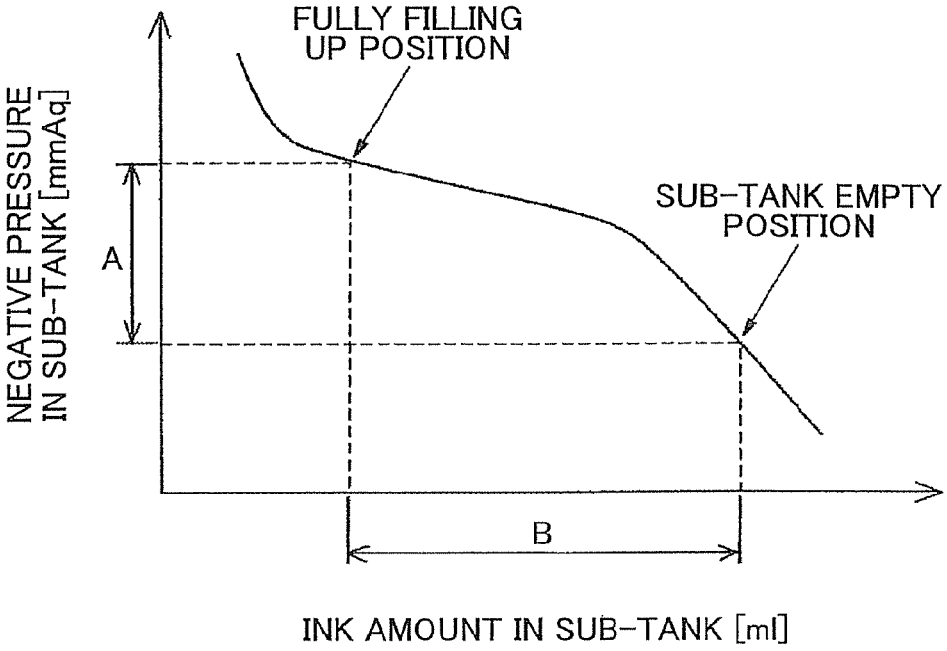
FIG. 8 illustrates a relationship between negative pressure and an ink amount in the sub-tank.

That is, as shown in FIG. 8, the negative pressure in the sub-tank 35 is correlated with the ink amount in the sub-tank 35. When the ink amount in the sub-tank 35 is large (corresponding to the leftward direction in FIG. 8), the negative pressure in the sub-tank 35 is small and weak (corresponding to the upward direction in FIG. 8). When the ink amount in the sub-tank 35 is small (corresponding to the rightward direction in FIG. 8), the negative pressure in the sub-tank 35 is large and strong (corresponding to the downward direction in FIG. 8). It is noted that in FIG. 8, the upward direction corresponds to a direction in which the pressure in the sub-tank 35 becomes higher (i.e., the negative pressure in the sub-tank 35 becomes smaller and weaker), and the rightward direction corresponds to a direction in which the ink amount in the sub-tank 35 becomes smaller. When the negative pressure in the sub-tank 35 is too weak, the ink may leak from the recording head 34. When the negative pressure in the inside of the sub-tank 35 is too strong, air or dust/dirt may enter the recording head 34, and a failure may be likely to occur in operation of discharging the ink from the recording head 34.

Therefore, in the embodiment of the present invention, supply of the ink to the sub-tank is controlled in such a manner that the ink amount in the sub-tank 35 falls within the range B of the ink amount (see FIG. 8) such that the negative pressure in the sub-tank 35 falls within the predetermined negative pressure control range A. It is noted that below, the ink amount in the sub-tank 35 corresponding to the lower limit of the negative pressure control range A (at which the negative pressure is small and weak and the ink amount is large) will be referred to as a "fully filling up position" as a displacement position of the displacement member 205 (with respect to the carriage 33). The ink amount in the sub-tank 35 corresponding to the upper limit of the negative pressure control range A (at which the negative pressure is large and strong and the ink amount is small) will be referred to as a "sub-tank empty position" (i.e., a position which is set as there is no remaining ink) as a displacement position of the displacement member 205 (with respect to the carriage 33).

Next, a method of setting the ink amount in the sub-tank 35 at the fully filling up position will be described with reference to FIGS. 9A, 9B and 9C. It is noted that, different from FIGS. 3 and 4, the sub-tank 35 is schematically shown in the figures described below.

Figure 9A:
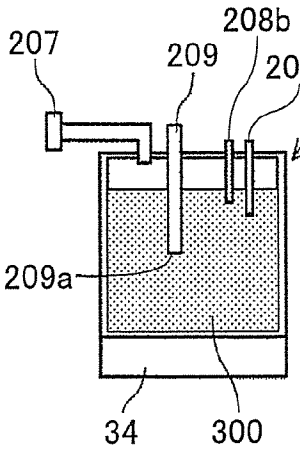
FIGS. 9A, 9B and 9C illustrate a method of setting an ink amount in the sub-tank at a fully filling up state.
Figure 9B:
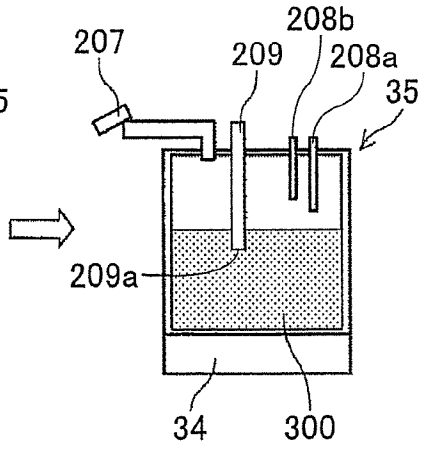

By releasing the negative pressure from the sub-tank 35 by opening the atmosphere opening mechanism 207 from the state shown in FIG. 9A, the liquid surface in the sub-tank 35 falls as shown in FIG. 9B. It is noted that, at this time, it is preferable that a supply mouth 209*a* of the supply port 209 exists below the liquid surface. That is, when the supply mouth 209*a* is above the liquid surface, air enters the ink supply tube 36 from the supply mouth 209*a* of the supply port 209. As a result, when the ink is supplied to the sub-tank 35 via the supply port 209 subsequently, bubbles may be discharged from the supply mouth 209*a* together with the ink. In this case, when the supplying is further continued, the bubbles may adhere to the inside of the atmosphere opening mechanism 207, and sticking of the valve body 207*b* or liquid leakage may occur.

Figure 9C:
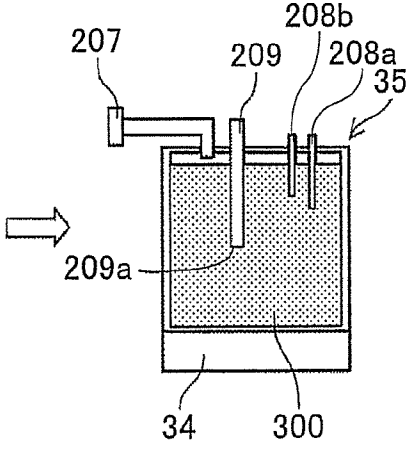

Then, after the negative pressure is thus released and the liquid surface falls, the ink 300 is supplied as shown in FIG. 9C. The ink 300 is supplied until the liquid surface rises, and thus, the electrode pins 208*a* and 208*b* detect the liquid surface. In other words, the ink 300 is supplied until the liquid surface reaches a predetermined position. This process will be referred to as an atmosphere opening filling process, hereinafter. After that, the atmosphere opening mechanism 207 is closed. Then, for example, a predetermined amount of the ink is suctioned and discharged from the sub-tank 35 so that the negative pressure in the sub-tank 35 reaches a predetermined negative pressure value. Thus, it is possible to cause the ink amount in the sub-tank 35 to be at the fully filling up position where the predetermined negative pressure value is obtained.

Next, with reference to FIGS. 10A, 10B, 11A, 11B, 11C and 11D, detection of a displacement amount (i.e., a rotation amount) of the displacement member 205 of the sub-tank 35 will be described.

Figure 10A:
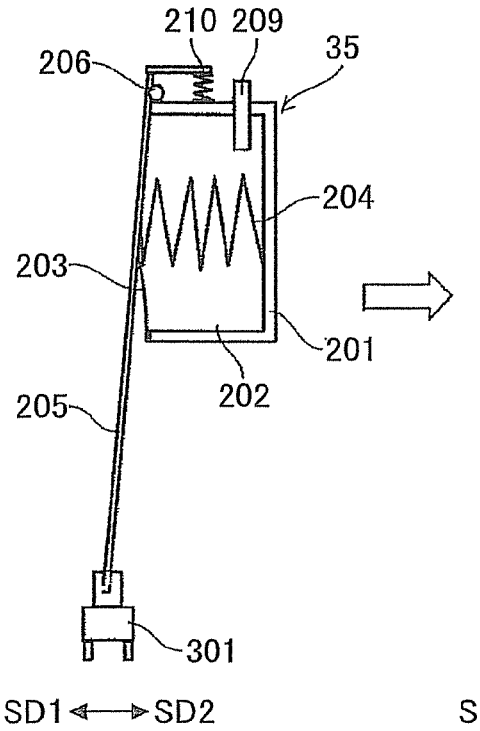
FIGS. 10A and 10B illustrate a method of setting the ink amount in the sub-tank at the fully filling up state by using only a second sensor.
Figure 10B:
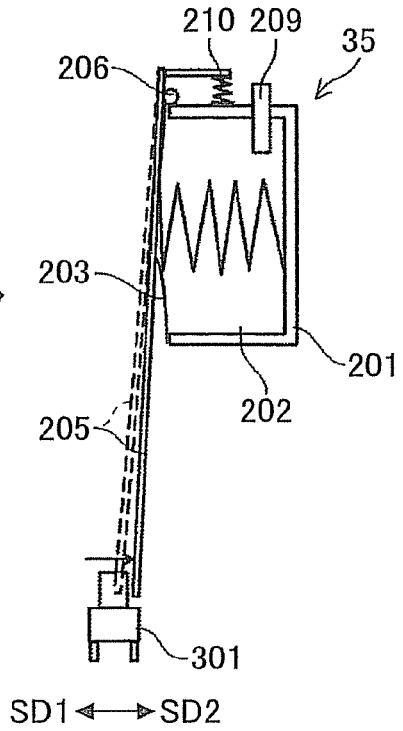

First, with reference to FIGS. 10A and 10B, a case of detecting a displacement amount of the displacement member 205 (with respect to the carriage 33) by using only the second sensor (fully filling up sensor) 301 provided to the body of the image forming apparatus 1 will be described. First, a position of the carriage 33 when the second sensor 301 detects the displacement member 205 of the sub-tank 35 as shown in FIG. 10A is stored in the RAM 503 or such. The position of the carriage 33, i.e., a carriage position, is detected by using the linear encoder 90 (see FIG. 2). Then, with reference to FIG. 10B, in a case where the displacement member 205 has moved from the position indicated by broken lines to the position indicated by solid lines in the main scan direction SD2, the displacement member 205 has become apart from the second sensor 301 where the second sensor 301 does not detect the displacement member 205. Then, from this state, the carriage 33 is moved in the main scan direction SD1 until the second sensor 301 detects the displacement member 205 so as to cancel out the displacement amount of the displacement member 205. Then, the difference (carriage moving amount) between the current position of the carriage 33 and the position of the carriage 33 stored in the RAM 503 or such as mentioned above can be obtained as the displacement amount of the displacement member 205.

Next, a case of the ink amount in the sub-tank 35 is set to correspond to the above-mentioned fully filling up position by using only the second sensor 301 will be described. For example, the above-mentioned atmosphere opening filling process is carried out. That is, the atmosphere opening mechanism 207 is opened, thus the inside of the sub-tank comes to have the atmospheric pressure, and the ink is supplied to the sub-tank 35 until the ink in the sub-tank 35 reaches the position at which the electrode pins 208*a* and 208*b* detect the liquid surface. After that, the atmosphere opening mechanism 207 is closed. The displacement position of the displacement member 205 at this time will be referred to as an atmosphere opening position. At this time, the carriage 33 is moved in the main scan direction SD1 or SD2 so that the displacement member 205 is detected by the second sensor 301. Then, the position of the carriage 33 at which the second sensor 301 thus detects the displacement member 205 is stored in the RAM 503 or such as an atmosphere opening position. Then, the predetermined amount of the ink is suctioned and discharged from the recording head 34 and thus the predetermined amount of the ink is suctioned from the sub-tank 35. Thus, as mentioned above, the predetermined negative pressure value is obtained in the sub-tank 35, and at this time, the current position of the displacement member 205 is determined as the fully filling up position. At this time, the ink amount in the sub-tank 35 is set at the fully filling up position as mentioned above. Since the predetermined amount of the ink has been suctioned as mentioned above from the above-mentioned state where the position of the carriage 33 has been stored as the atmosphere opening position in the RAM 503 or such, the current position (fully filling up position) of the displacement member 205 with respect to the carriage 33 is the position shifted inward (toward the inside of the sub-tank 35).

Then, the displacement amount of the displacement member 205 between the position obtained when the atmosphere opening filling process has been finished and the fully filling up position is obtained as the carriage moving amount in the method described above with reference to FIGS. 10A and 10B. Then, the carriage 33 is moved from the atmosphere opening position by the thus-obtained carriage moving amount in such a direction as to cancel out the corresponding displacement amount of the displacement member 205. Thus, it is possible to move the carriage 33 to the position where the displacement member 205 is detected by the second sensor 301 when the displacement member 205 is at the fully filling up position. This position of the carriage 33 will be referred to as a fully filling up detection position. Thus, since the second sensor 301 is provided to the body of the image forming apparatus 1, it is possible to set the displacement member 205 at the fully filling up position (where the ink amount in the sub-tank 35 corresponds to the fully filling up position) by creating the state where the carriage 33 is at the fully filling up detection position and the displacement member 205 is detected by the second sensor 301.

However, in this method of setting the ink amount in the sub-tank 35 at the fully filling up position by using only the second sensor 301, it is necessary to detect the displacement member 205 of the sub-tank 35 when the sub-tank 35 is filled with the ink corresponding to the fully filling up position. For this purpose, it is necessary each time to move the carriage 33 so that the displacement member 205 of the sub-tank 35 reaches the fully filling up detection position at which the second sensor 301 can detect the displacement member 205 when the displacement member 205 is at the fully filling up position.

This means, when the sub-tank 35 is filled with the ink corresponding to the fully filling up position during a printing operation, it is necessary to interrupt the printing operation to move the carriage to the position at which the second sensor 301 detects the displacement member 205.

Therefore, in order that it is possible to fully fill up the sub-tank with the ink without interrupting the printing operation, the first sensor 251 is provided to the carriage 33 for detecting the displacement member 205 of the sub-tank 25 in addition to the second sensor 301 provided to the body of the image forming apparatus 1 according to the embodiment of the present invention.

That is, the position of the displacement member 205 with respect to the carriage 33 when the second sensor 301 provided to the body of the image forming apparatus 1 detects the displacement member 205 in the condition where the carriage 33 is at the fully filling up detection position is determined as a second position, and the second position is determined as the fully filling up position. Further, the position of the displacement member 205 when the first sensor 251 provided to the carriage 33 detects the displacement member 205 is determined as a first position, and the first position is determined as a position of the displacement member 205 where the ink remaining amount in the sub-tank 35 is smaller than the ink remaining amount in the sub-tank 35 when the displacement member 205 is at the second position.

In other words, according to the embodiment of the present invention, the first detection part (first sensor) 251 is provided to the carriage 33, which detects that the displacement member 205 comes to the predetermined first position. The second detection part (second sensor) 301 is provided to the body of the image forming apparatus 1, which detects that the displacement member 205 comes to the predetermined second position (fully filling up position) when the carriage 33 is stopped at the predetermined detection position (i.e., the fully filling up detection position) and the liquid is supplied to the sub-tank 35 from the main tank 10. Further, the first position of the displacement member 205 is a position such that the liquid remaining amount in the sub-tank 35 is smaller than the liquid remaining amount in the sub-tank 35 when the displacement member 205 is at the second position.

A method of setting the ink amount in the sub-tank 35 to the above-mentioned fully filling up position (i.e., carrying out an operation of supplying the liquid to the sub-tank 35 until the liquid surface of the ink in the sub-tank 35 has the fully filling up position) will now be described.

First, the above-mentioned atmosphere opening filling process is carried out. After that, the atmosphere opening mechanism 207 is closed. Then, the carriage 33 is moved in the main scan direction SD1 or SD2 so that the displacement member 205 is detected by the second sensor 301. Thus, the state of FIG. 11A is obtained where the carriage 33 is at the atmosphere opening position.

Figure 11A:
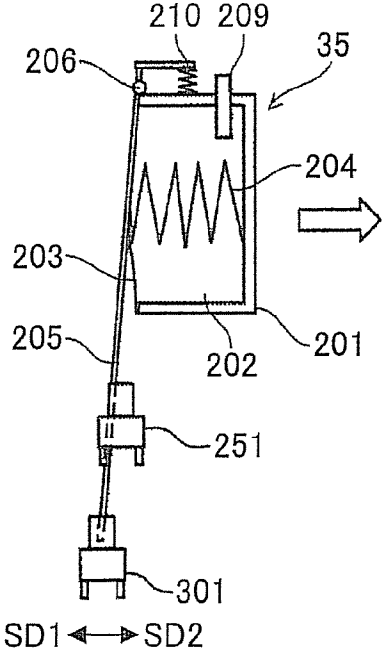
FIGS. 11A, 11B, 11C and 11D illustrate a method of setting the ink amount in the sub-tank at the fully filling up state by using a first sensor and the second sensor.
Figure 11B:
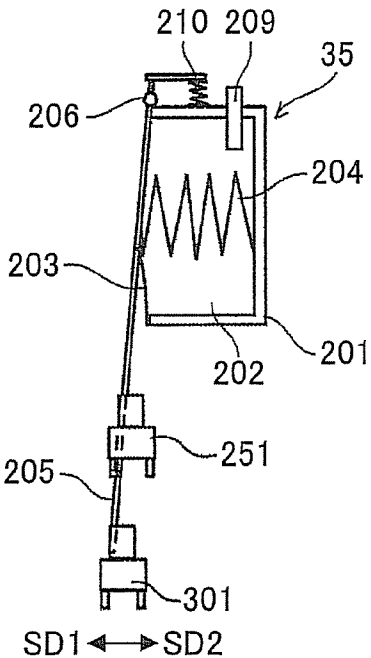
Figure 11C:
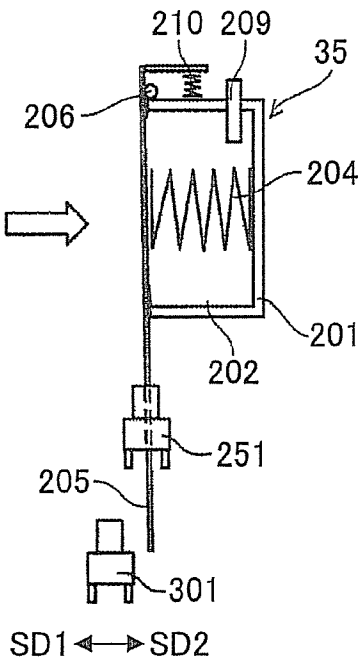
Figure 11D:
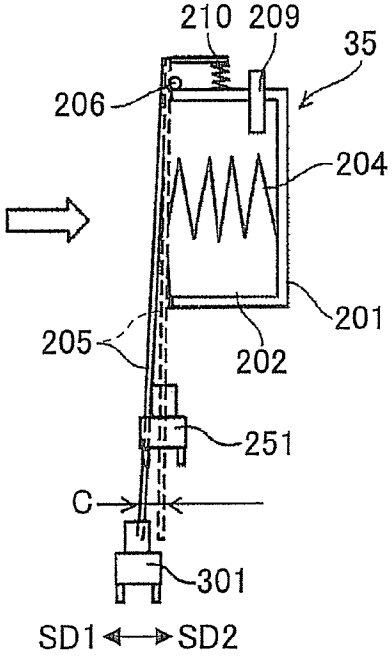

Then, from this state where the carriage 33 is at the atmosphere opening position at which the second sensor 301 detects the displacement member 205 as shown in FIG. 11A, the carriage 33 is moved in the main scan direction SD1 to the fully filling up detection position as shown in FIG. 110. It is noted that the carriage moving amount has been obtained as mentioned above corresponding to the displacement amount of the displacement member 205 between the position obtained when the atmosphere opening filling process has been finished and the fully filling up position. Then, by moving the carriage 33 by this carriage moving amount in such a direction as to cancel out the corresponding displacement amount, it is possible to move the carriage to the fully filling up detection position. Then, the liquid feeding pump 241 is driven in reverse and the ink is suctioned from the sub-tank 35 to the main tank 10 until the displacement member 205 passes through a position at which the first sensor 251 detects the displacement member 205 as shown in FIG. 11C. After that, the liquid feeding pump 241 is driven forward and thus the ink is supplied (the ink is fed) to the sub-tank 35 from the main tank 10. Then, the second sensor 301 detects the displacement member 205 as shown in FIG. 11D, and the feeding of the ink to the sub-tank 35 is stopped (where the displacement member 205 is at the fully filling up position).

Here, the total amount of the liquid (ink) fed by the liquid feeding pump 241 while the liquid feeding pump 241 is driven forward from the time the first sensor 251 detects the displacement member 205 to the time the second sensor 301 detects the displacement member 205 is detected as a differential supply amount. Thereby, it is possible to obtain the differential supply amount corresponding to a displacement amount C by which the position of the displacement member 205 is changed (i.e., the position of the flexible film 203 is changed) from the position detected by the first sensor 251 to the position detected by the second sensor 301. The thus-detected differential supply amount corresponding to the displacement amount C is stored in the RAM 503 or such.

In this case, it is possible to obtain, as the differential supply amount, the total time period (the total driving time period of the liquid feeding pump 241) or the total number of rotations (the total number of driving rotations of the liquid feeding pump 241) from the time the first sensor 251 detects the displacement member 205 to the time the second sensor 301 detects the displacement member 205.

Thus, the differential supply amount (displacement amount C) is obtained and stored in the RAM 503 or such. Then, when it is detected that a predetermined amount of ink has been discharged during scanning operations of the carriage 33 (when the ink consumption amount reaches the predetermined amount), the ink is supplied to the sub-tank 35 from the main tank 10. At this time, by supplying the above-mentioned differential supply amount of the ink after the first sensor 251 detects the displacement member 205, it is possible to supply the ink to the sub-tank corresponding to the fully filling up position.

In this case, the detection by the first sensor 251 is a detection of the position. Therefore, cumulation of the detection errors, such as the detection errors in the ink discharging amount, the liquid feeding amount of the liquid feeding pump 241, and so forth, if any, are cancelled at a time the first sensor 251 detects the position. Thus, it is possible to avoid accumulation of the detection errors, and it is possible to repetitively carry out ink discharge and ink supply even during scanning operations of the carriage 33.

By repeating the series of these operations, it is possible to supply the ink to the sub-tank 35 corresponding to the fully filling up position without interrupting printing operations, and thus, it is possible to improve the printing speed and the printing efficiency.

Here, with reference to FIGS. 12 and 13, examples where an arrangement of the first sensor 251 and the second sensor 301 is different will be described.

Figure 12:
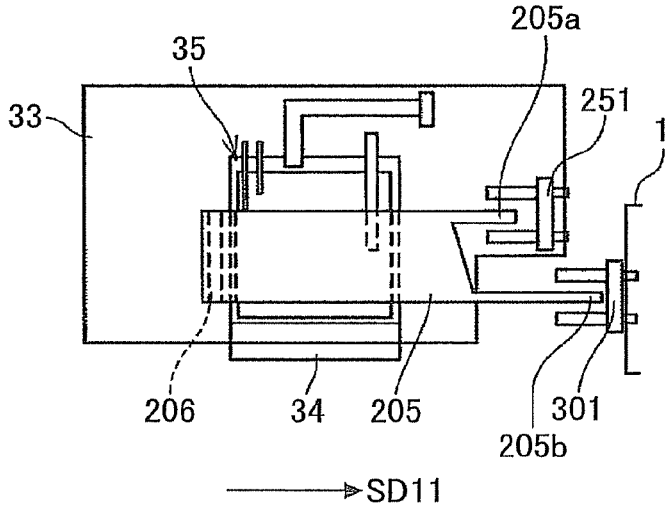
FIG. 12 illustrates one example of an arrangement of the first sensor and the second sensor.

An example of FIG. 12 is an example where detection parts 205*a*, 205*b* having different lengths from the supporting shaft (swinging fulcrum) 206 of the displacement member 205 are provided to the displacement member 205 of the sub-tank 35. In this case, the first sensor 251 provided to the carriage 33 detects the detection part 205*a*, and the second sensor 301 provided to the body of the image forming apparatus 1 detects the detection part 205*b*.

Figure 13:
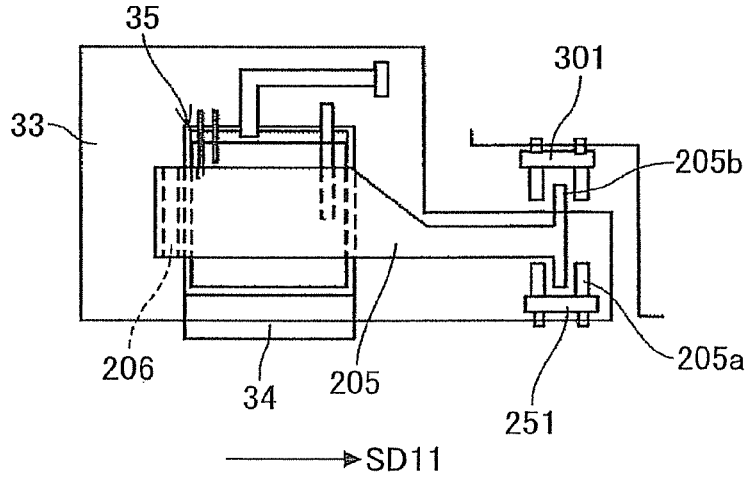
FIG. 13 illustrates another example of an arrangement of the first sensor and the second sensor.

An example of FIG. 13 is an example where detection parts 205*a*, 205*b* having the same lengths from the supporting shaft (swinging fulcrum) 206 are provided to the displacement member 205 of the sub-tank 35. In this case, the first sensor 251 provided to the carriage 33 detects the detection part 205*a*, and the second sensor 301 provided to the body of the image forming apparatus 1 detects the detection part 205*b*.

Next, the supply amount (the above-mentioned differential supply amount) to be supplied to the sub-tank 35 during printing operations according to the detected displacement amount C will be described.

In a case where the detected displacement amount C is equal to or less than a predetermined lower limit value corresponding to a very small amount such that the liquid feeding pump 241 is hardly driven, the liquid supply amount corresponding to the predetermined lower limit value is set as the differential supply amount to be supplied from when the first sensor 351 detects the displacement member 205 when the ink is supplied during a printing operation. In a case where the detected displacement amount C is equal to or more than a predetermined upper limit value, the liquid supply amount corresponding to the predetermined upper limit value is to be set as the differential supply amount to be supplied from when the first sensor 351 detects the displacement member 205 when the ink is supplied during the printing operation.

Next, the above-described operation carried out by the control part 500 will be described with reference to FIGS. 14 and 15 (flowcharts).

Figure 14:
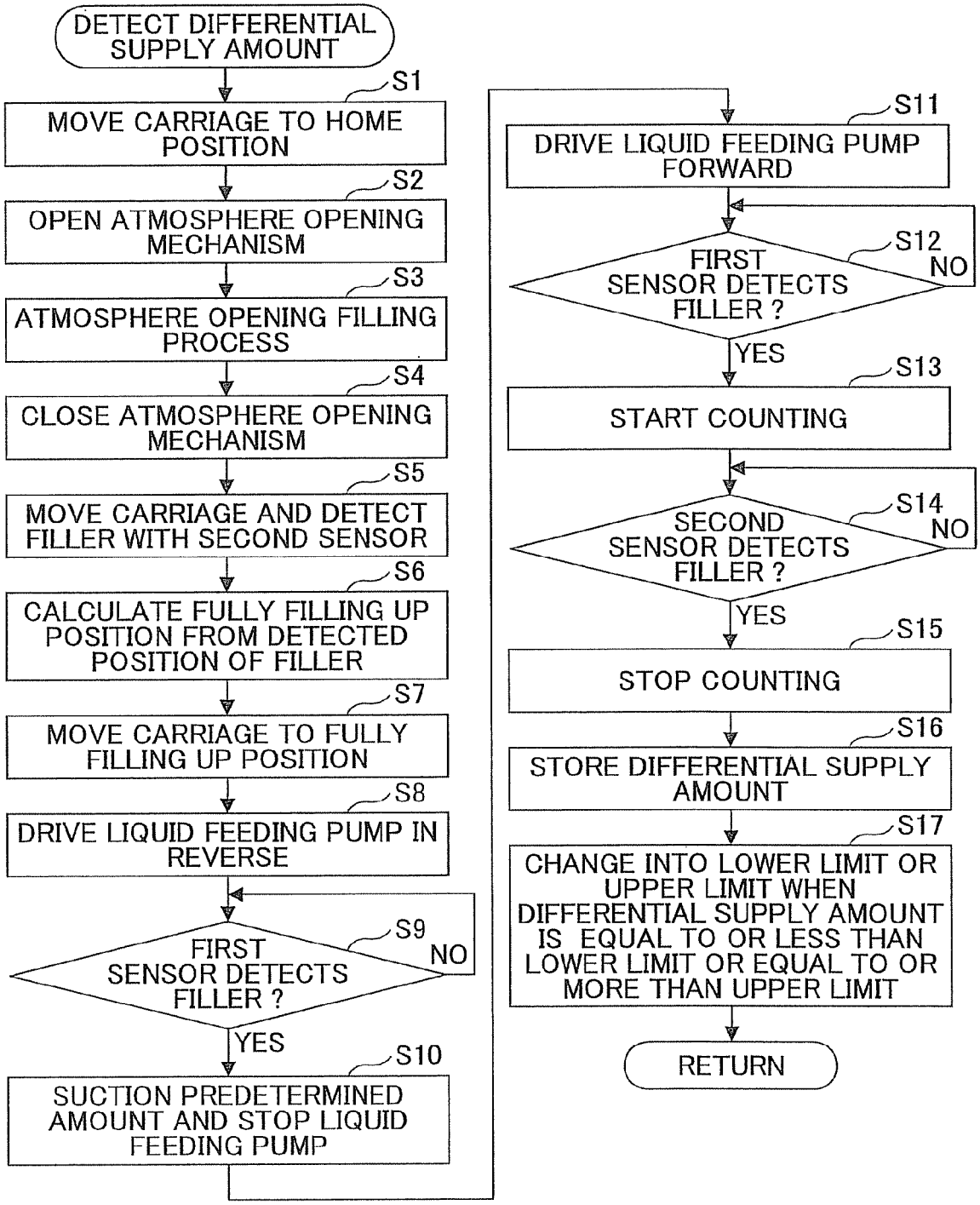
FIG. 14 is a flowchart illustrating a process of detecting a differential supply amount by the control part.
Figure 15:
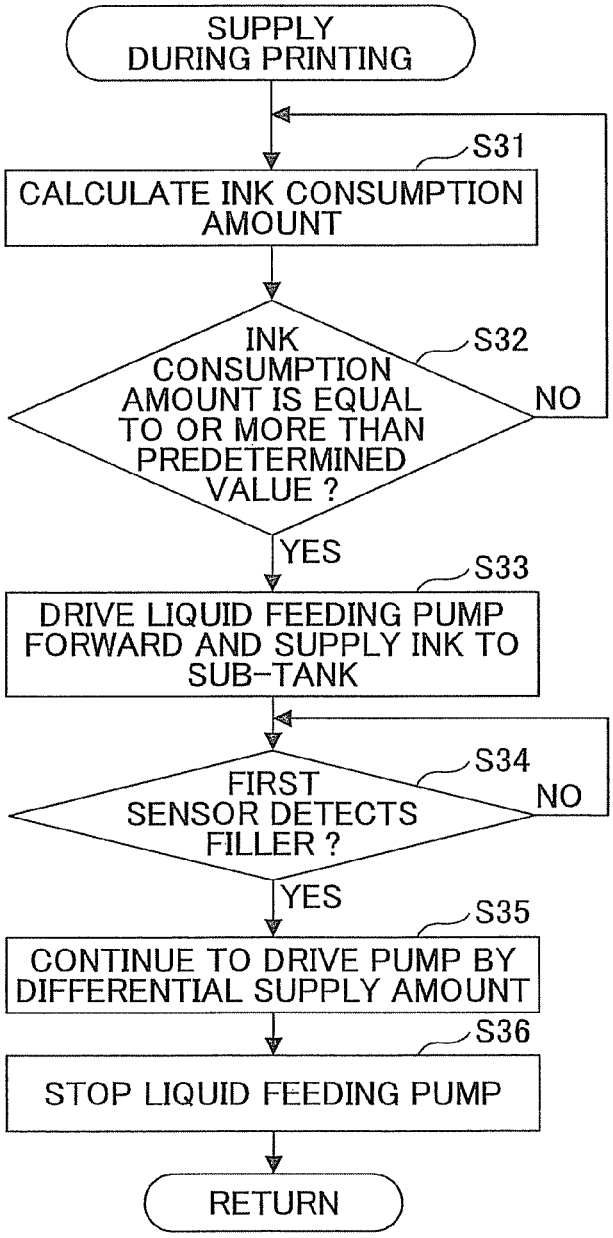
FIG. 15 is a flowchart illustrating a process of supplying the ink to the sub-tank during printing by the control part.

First, in a differential supply amount detection process of obtaining the differential supply amount shown in FIG. 14, the carriage 33 is moved to the home position (step S1), capping by the caps 82*a* is carried out, the atmosphere opening mechanism 207 of the sub-tank 35 is opened (step S2), and the above-mentioned atmosphere opening filling process is carried out where the ink is supplied to the sub-tank 35 from the main tank 10 while the liquid surface is detected by the electrode pins 208*a* and 208*b* (step S3).

After that, the atmosphere opening mechanism 207 of the sub-tank 35 is closed (step S4), the carriage 33 is moved, and thus the displacement member 205 is detected by the second sensor 301 (where the carriage 33 is at the atmosphere opening position) (step S5) while the moving amount of the carriage 33 is detected by means of the linear encoder 90. Then, based on the position of the carriage 33 when the displacement member 205 is detected by the second sensor 301 (atmosphere opening position) (see FIG. 11A), the fully filling up detection position of the carriage 33 (see FIG. 11B) is calculated (step S6).

It is noted that the carriage moving amount has been obtained as mentioned above corresponding to the displacement amount of the displacement member 205 between the position obtained when the atmosphere opening filling process has been finished and the fully filling up position. Then, by moving the carriage 33 by this carriage moving amount in such a direction as to cancel out the corresponding displacement amount, it is possible to move the carriage to the fully filling up detection position. Then, by using this carriage moving amount, it is possible to calculate the fully filling up detection position of the carriage 33 in step S6.

Next, the carriage 33 is moved to the fully filling up detection position (step S7), and then, in step S8, the liquid feeding pump 241 is driven in reverse and the ink is suctioned from the sub-tank 35. Then, after the displacement member 205 passes through the first sensor 251 (YES in step S9) (see FIG. 11C), the liquid feeding pump 241 is further driven in reverse, and then is stopped after a predetermined amount of the ink is further suctioned from the sub-tank 35 by the liquid feeding pump 241 (step S10).

Then, the liquid feeding pump 241 is driven forward and the ink is supplied to the sub-tank 35 from the main tank 10 (step S11). Then, when the first sensor 251 again detects the displacement member 205 of the sub-tank 35 (step S12), measurement (counting) of, for example, a time period of driving the liquid feeding pump 241 or the total number of rotations of driving the liquid feeding pump 241 is started (step S13). Then, the liquid feeding pump 241 is further driven forward so that supplying the ink to the sub-tank 35 is continued. Then, when the second sensor 301 detects the displacement member 205 of the sub-tank 35 (step S14 YES) (see FIG. 11D), the liquid feeding pump 241 is stopped, and also, the measurement (counting) of the time period of driving the liquid feeding pump 241 or the total number of rotations of driving the liquid feeding pump 241 is stopped (step S15).

As a result of starting and stopping of the measurement (counting) in step S13 and step S15, the total liquid supply amount (as the differential supply amount) is calculated as, for example, the time period of driving the liquid feeding pump 241 or the total number of rotations of driving the liquid feeding pump 241 from when the first sensor 251 detects the displacement member 205 of the sub-tank 35 (step S12) to when the second sensor 301 detects the displacement member 205 of the sub-tank 35 (step S14).

Then, when the thus-calculated total liquid supply amount is equal to or less than the above-mentioned predetermined lower limit value, the predetermined lower limit value is stored in the RAM 503 or such as the differential supply amount (steps S16 and S17). When the thus-calculated total liquid supply amount is equal to or more than the above-mentioned predetermined upper limit value, the predetermined upper limit value is stored in the RAM 503 or such as the differential supply amount (steps S16 and S17). When the thus-calculated total liquid supply amount is more than the above-mentioned predetermined lower limit value and less than the predetermined upper limit value, the calculated total liquid supply amount is stored in the RAM 503 or such as the differential supply amount (steps S16 and S17).

Thus, according to the embodiment, the carriage 33 is stopped at the fully filling up detection position where the displacement member 205 of the sub-tank 35 at the fully filing up position is detected by the second sensor 301. Then, the liquid (ink) is supplied to the sub-tank from the main tank 10, and the differential supply amount corresponding to the displacement amount (C) of the displacement member 205, from when the first sensor 251 detects the displacement member to when the second sensor 301 detects the displacement member 205, is detected and stored.

Next, with reference to FIG. 15, a process of supplying the ink during printing operations will be described. First, an ink consumption amount in the sub-tank 35 is calculated (step S31). This calculation of the ink consumption amount can be computationally obtained from counting the number of ink droplets discharged from the recording head 34 for the purpose of forming an image and the number of ink droplets discharged as a dummy discharge operation during printing operations, and multiplying the given ink amount of the corresponding ink droplet by the thus-counted number of ink droplets. This method of calculating the total ink discharge amount may be referred to as "soft counting", hereinafter. When a cleaning operation of suctioning the ink from the recording head 34 as mentioned above as the maintenance and recovery operation is carried out, the ink consumption amount (suctioning amount) in the suctioning for the cleaning is previously determined, and thus, the determined suctioning amount may be added to the result of the soft counting to obtain the final total ink discharge amount.

Then, in step S32, it is determined whether the ink remaining amount in the sub-tank 35 calculated from the given ink amount in the sub-tank 35 at the fully filling up position and the above-mentioned ink consumption amount, has reached a predetermined amount. When the ink remaining amount has reached the predetermined amount (step S32 YES), the liquid feeding pump 241 is driven forward, and the ink is supplied from the main tank 10 to the sub-tank 35 (step S33). At this time, it is determined whether the first sensor 251 has detected the displacement member 205 of the sub-tank 35 (step S34). Then, when the first sensor 251 has detected the displacement member 205 of the sub-tank 35 (step S34 YES), from this time point the differential supply amount of the ink is further supplied to the sub-tank 35. Thereby, it is possible to fill the sub-tank 35 with the ink corresponding to the fully filling up position.

After that, the liquid feeding pump 241 is stopped, and the above-mentioned calculated value of the ink consumption amount is reset.

Thus, even during printing operations, it is possible to fill the sub-tank 35 with the ink corresponding to the fully filling up position, without returning the carriage 33 to the home position.

Thus, according to the embodiment of the present invention, the sub-tank 35 has the displacement member 205 that changes its position according to the liquid (ink) remaining amount in the sub-tank 35. To the carriage 33, the first detection part 251 is provided for detecting that the displacement member 205 comes to the predetermined first position. To the body of the image forming apparatus 1, the second detection part 301 is provided for detecting that the displacement member 205 comes to the predetermined second position. The first position is such that the liquid remaining amount in the sub-tank 35 when the displacement member 205 is at the first position is smaller than the liquid remaining amount in the sub-tank 35 when the displacement member 205 is at the second position. The differential supply amount corresponding to the displacement amount C between the position of the displacement member 205 detected by the first detection part 251 and the position of the displacement member 205 detected by the second detection part 301 is detected and stored. Then, the control part 500 is provided for carrying out control such that when the liquid is supplied from the main tank 10 to the sub-tank 35 without using the second detection part 301, the differential supply amount of the liquid is supplied to the sub-tank after the first detection part 251 has detected the displacement member 205. Thereby, even while the carriage 33 is moving, it is possible to supply the appropriate amount of the liquid to the sub-tank 35 from the main tank 10, and thus, it is possible to improve the printing speed.

Here, a reason is given for also providing the second sensor 301 to the body of the image forming apparatus 1 instead of detection being carried out by using only the first sensor 251 provided to the carriage 33.

First, the position of the displacement member 205 when the sub-tank 35 is fully filled up with the ink may change depending on the environment. However, the change amount cannot be determined by the first sensor 251 mounted on the carriage 33 since the first sensor 251 can detect only the position of one point. Therefore, in the embodiment, by providing the second sensor 251 to the body of the image forming apparatus 1, it becomes possible to detect the change amount by moving the carriage 33 to the atmosphere opening position and to the fully filling up detection position which may change according to the environment.

That is, it is possible to detect the displacement amount C between the two points, i.e., the detection point fixed to the carriage 33 (the first point) and the detection point (the second point) for which the detection position is changeable as a result of the carriage 33 being moved can be detected as the time period or the total number of rotations of driving the liquid feeding pump 241, or the distance between the two points can be detected by the linear encoder 90 or such. Thus, it is possible to carry out control of the ink supply amount depending on the environment.

Further, when a sensor, an encoder or such is provided to detect all the displacements of the displacement member 205, additional cost of the sensor or the encoder may be incurred, further the size of the carriage 33 may increase, and thus, the size of the image forming apparatus may increase.

Further, the liquid feeding amount (supply amount or suction amount) of the liquid feeding pump 241 may vary depending on the environment, aging, scattering of the sizes or such of the parts/components of each particular product of the liquid feeding pump 241, and so forth. Therefore, it is advantageous to obtain the pump supply amount required for reaching the detection position detected by the second sensor 301 provided to the body of the image forming apparatus 1, which position may vary depending on the environment. When the second sensor 301 is not provided to the body of the image forming apparatus 1 and the pump supply amount is controlled by only the driving amount of the liquid feeding pump 241, a failure due to an excess or a shortage in the pump supply amount may occur. Therefore, by providing the second sensor 301 to the body of the image forming apparatus 1, it is possible to secure the safety in the control.

Figure 16A:
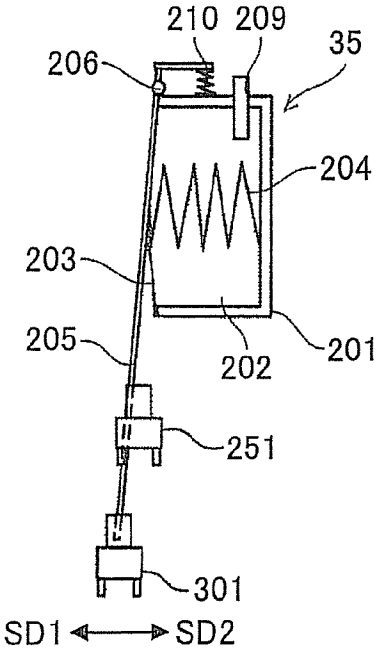
FIGS. 16A, 16B and 16C illustrate a second embodiment of the present invention.
Figure 16B:
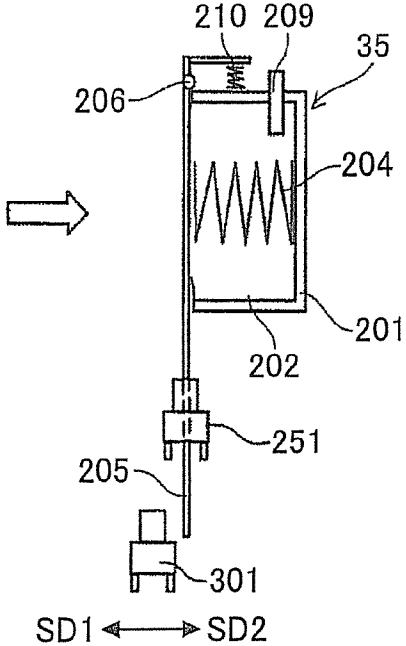
Figure 16C:
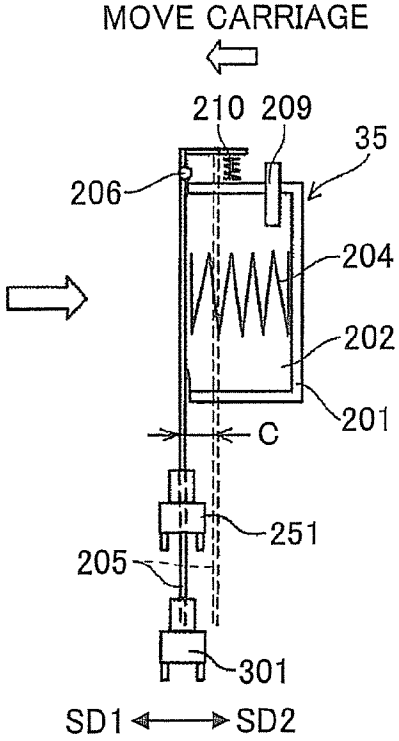

Next, a second embodiment of the present invention will be described with reference to FIGS. 16A, 16B and 16C. FIGS. 16A, 16B and 16C illustrate the second embodiment of the present invention.

In the second embodiment, the differential supply amount corresponding to the displacement amount C between the position of the displacement member 205 detected by the first sensor 251 and the position of the displacement member 205 detected by the second sensor 301 is detected. In the second embodiment, as shown in FIG. 16A, the carriage 33 is moved to the position where the second sensor 301 detects the displacement member 205. Then, from this state where the displacement member 205 is at the atmosphere opening position (see FIG. 11A) or the fully filling up position (see FIG. 11D), the liquid feeding pump 241 is driven in reverse. Then, when the first sensor 251 detects the displacement member 205 as a result of the reverse driving of the liquid feeding pump 241 and thus the ink being suctioned from the sub-tank 35, the liquid feeding pump 241 is stopped (FIG. 16B). Then, as shown in FIG. 16C, the carriage 33 is moved until the second sensor 301 detects the displacement member 205. Then, the moving amount of the carriage 33 from the position of FIG. 16B to the position of FIG. 16C is measured by the linear encoder 90. Thus, the displacement amount of the flexible film 203 or of the displacement member 205 is detected between the state where the displacement member 205 is at the atmosphere opening position (see FIG. 11A) or the state where the displacement member 205 is at the fully filling up position (see FIG. 11D) and the state where the displacement member 205 is detected by the first sensor 251 (see FIG. 11C) (first sensor detection position), and the differential supply amount corresponding to the displacement amount is measured.

The thus-obtained moving amounts of the carriage 33 as the displacement amounts or the differential supply amounts may be used as follows. That is, after the state of the displacement member 205 of FIG. 11A (the atmosphere opening position) is obtained, the carriage 33 is moved in the main scan direction SD1 by the moving amount corresponding to the displacement amount between the state of the displacement member 205 of FIG. 11A (the atmosphere opening position) and the state of the displacement member 205 of FIG. 11C (first sensor detection position). After that, the liquid feeding pump 241 is driven in reverse until the second sensor 301 detects the displacement member 205. Thus, it is possible to obtain the state of the displacement member 205 of FIG. 11C (first sensor detection position). Then, the carriage 33 is moved in the main scan direction SD2 by the moving amount corresponding to the displacement amount from the state of the displacement member 205 of FIG. 11C (first sensor detection position) to the state of the displacement member 205 of FIG. 11D (fully filling up position). Then, the liquid feeding pump 241 is driven forward until the second sensor 301 detects the displacement member 205. Thus, it is possible to obtain the state of the displacement member 205 of FIG. 11D (fully filling up position). Thus, the sub-tank 35 is filled with the ink corresponding to the fully filling up position by using only the second sensor 301.

Figure 17:
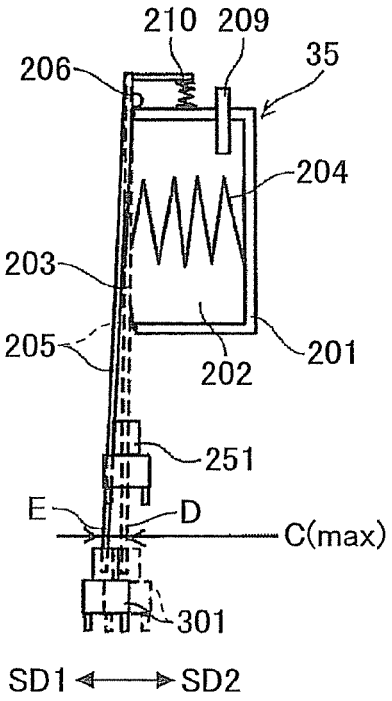
FIG. 17 is a schematic plan sectional view of a sub-tank for illustrating a third embodiment of the present invention.
Figure 18:
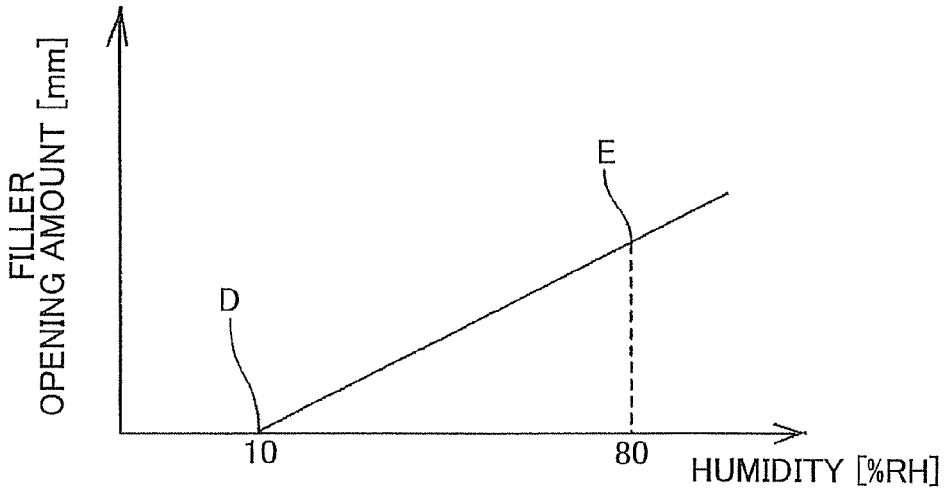
FIG. 18 illustrates one example of relationship between humidity and a displacement amount of a displacement member for illustrating the third embodiment.
Figure 19:
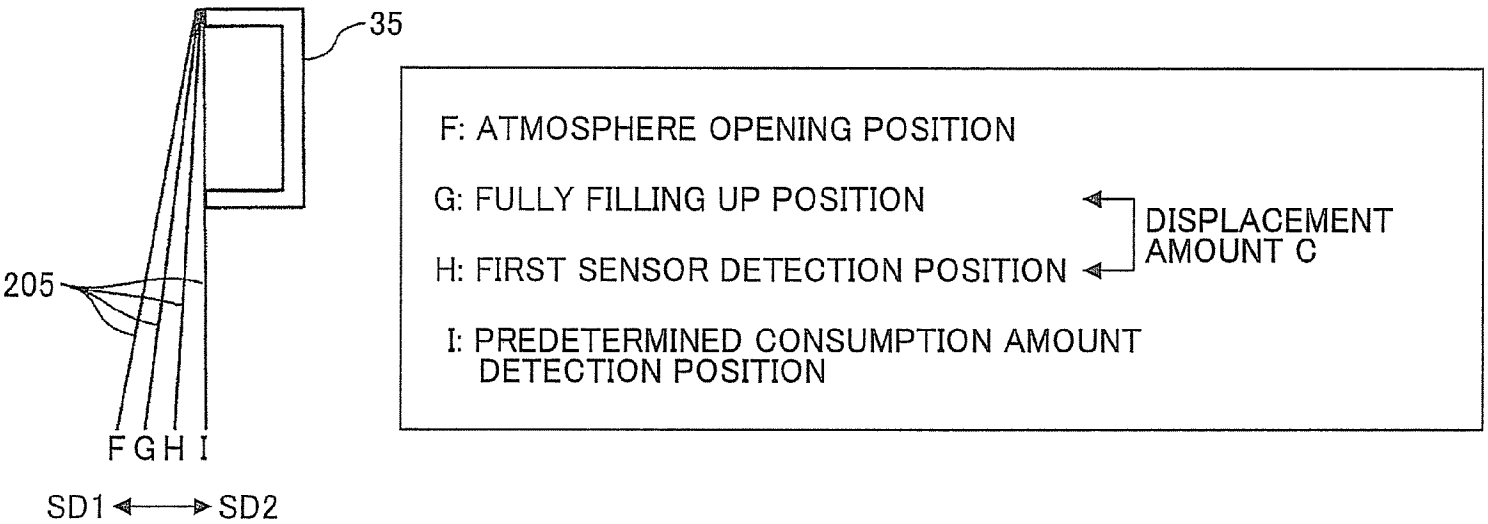
FIG. 19 illustrates the third embodiment.

Next, a third embodiment of the present invention will be described with reference to FIGS. 17, 18 and 19. FIG. 17 is a schematic sectional plan view illustrating the third embodiment. FIG. 18 shows one example of a relationship between humidity and a position of the displacement member 205 (FILLER OPENING AMOUNT). FIG. 19 illustrates the third embodiment.

The position of the flexible film 203 of the sub-tank 35 may change depending on the ambient environment. The flexible film 203 expands or contracts due to a change in the environment, for example, humidity. As shown in FIGS. 17 and 18, in a case where the position of the displacement member 205 at the fully filling up position at low humidity of 10% RH is a position D, the flexible film 203 expands and thus the displacement member 205 changes in its position to a position E accordingly when the humidity is increased to high humidity of 80% RH.

That is, due to a change in the ambient environment, the atmosphere opening position F and the fully filling up position G of the displacement member 205 shown in FIG. 19 change.

Therefore, the first sensor 251 is set at such a position that the first sensor 251 is capable of detecting the displacement member 205 when the flexible film 203 is under such a predetermined environment that the flexible film 203 contracts the most. For example, the first sensor 251 is set at such a position of being capable of detecting the displacement member 205 at the fully filling up position "D" even under the lowest humidity environment.

In this case, as shown in FIG. 17, under the lowest humidity environment, the position "D" of the displacement member 205 is determined as the fully filling up position "G" of the displacement member 205. This means that as shown in FIG. 17, the displacement member 205 at the fully filling up position "D" (shown by broken lines) is detected by the second sensor 301 (shown by broken lines) (as described above with reference to FIG. 11D). Thus, In this case, when the displacement member 205 changes in its position due to ink supply to the sub-tank 35 and thus comes to the fully filling up position "D", the first sensor 251 detects the displacement member 205, and at the same time, also the second sensor 301 detects the displacement member 205 (i.e., the displacement amount C=0).

On the other hand, under high humidity environment, the position "E" of the displacement member 205 is determined as the fully filling up position "G" of the displacement member 205. This means that as shown in FIG. 17, the displacement member 205 at the fully filling up position "E" (shown by solid lines) is detected by the second sensor 301 (shown by solid lines). Thus, in this case, when the displacement member 205 changes in its position due to ink supply to the sub-tank 35, first the first sensor 251 detects the displacement member 205, and after that, the second sensor 301 detects the displacement member 205.

At this time, the displacement amount C (max) of the displacement member 205 from when the first sensor 251 detects the displacement member 205 to when the second sensor 301 detects the displacement sensor 205 is stored in the RAM 503 or such. As a result, after that, even during printing operations, it is possible to supply the appropriate amount of ink to the sub-tank 35 by supplying the ink to the sub-tank 35 by the differential supply amount corresponding to the displacement amount C from when the displacement member 205 is at a first sensor detection position "H" (see FIG. 19) where the first sensor 251 detects the displacement member 251. Thus, it is possible to set the fully filling up position "G" of the displacement member 205 to the position suitable to each environment.

Further, a process of again measuring (again detecting) the displacement amount C may be carried out at a time point described below. For example, a humidity detection part (not shown) configured to detect the ambient environment is used, and, when a humidity difference equal to or more than a predetermined value is detected from humidity detected when the displacement amount C has been detected and stored at a certain time point, the displacement amount C is again measured and stored.

Further, in a case where the flexible film 203 of the sub-tank 35 expands or contracts due to a change in the environmental temperature, the first sensor 251 may be set at such a position that the first sensor 251 is capable of detecting the displacement member 205 when the flexible film 203 is under such a predetermined temperature environment that the flexible film 203 contracts the most. In this case, a temperature detection part (not shown) configured to detect the ambient environment is used, and, when a temperature difference equal to or more than a predetermined value is detected from a temperature detected when the displacement amount C has been detected and stored at a certain time point, the displacement amount C is again measured and stored.

Further, there may be a case where the displacement position "H" of the displacement member 205 where the first sensor 251 detects the displacement member 205 and the displacement position "I" of the displacement member 205 where the predetermined amount of the ink has been consumed are reversed from the state shown in FIG. 19, during printing operations, due to an influence of a sharp change in the environment, an unexpected error such as an error in detection of the ink discharge amount equal to or more than a predetermined amount, an error in detection of the liquid feeding amount equal to or more than a predetermined amount, or such. In in this case, if ink supply will be carried after consumption of the predetermined amount of the ink is detected until the displacement member 205 reaches the fully filling up position, the ink supply will be continued without the first sensor 251 detecting the displacement member 205. As a result, the ink amount in the sub-tank 35 may become excessive, resulting in damaging the sub-tank 35, or leakage of the ink.

Therefore, when the displacement member 205 has reached the position "I" where the ink has been consumed by the predetermined amount detected by the discharge amount, and also, the displacement member 205 has not passed through and thus has not been detected by the first sensor 251, such control is made that the ink is further discharged until the first sensor 251 detects the displacement member 205, and, after the first sensor 251 detects the displacement member 205, ink supply to the sub-tank 35 by the amount corresponding to the displacement amount C is carried out.

At this time, when these operations are repeated a predetermined number of times, the printing operation is interrupted, the carriage 33 is set at the fully filling up detection position again, and the displacement amount C is detected again (for example, in the flow of FIG. 14).

Figure 20:
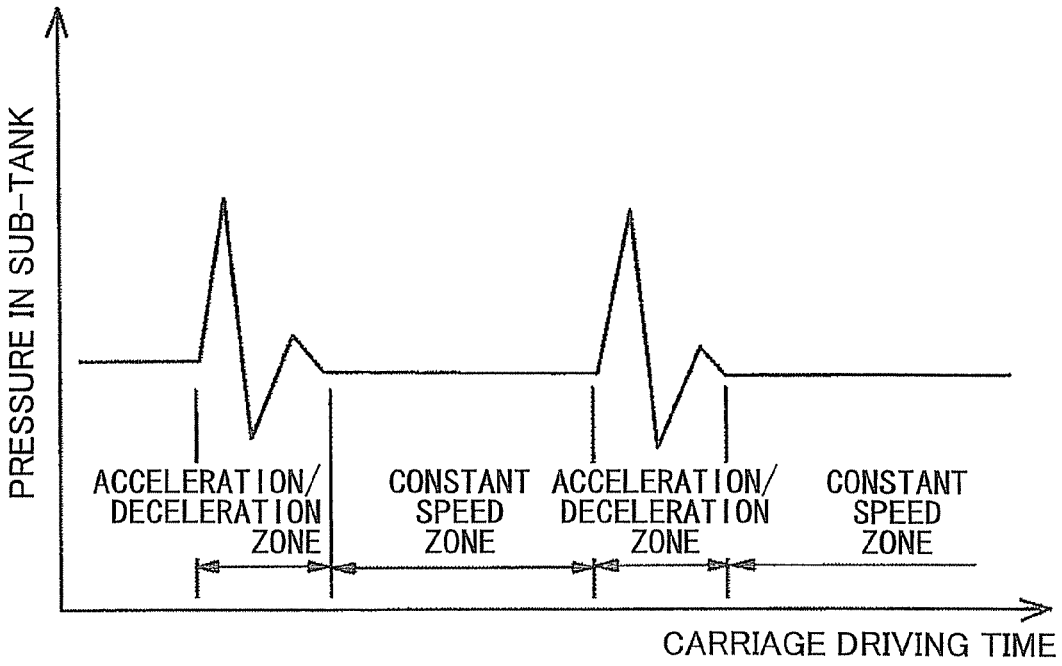
FIG. 20 illustrates a pressure variation in a sub-tank while a carriage carries out scanning operations for illustrating a fourth embodiment of the present invention.
Figure 21B:
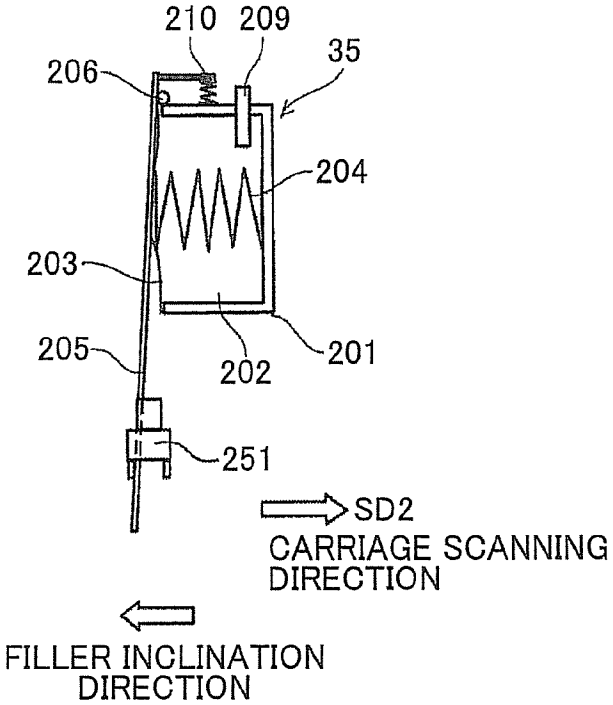
FIGS. 21A and 21B illustrate directions of scanning operations of the carriage and an inclination of a displacement member for illustrating the fourth embodiment of the present invention.
Figure 21A:
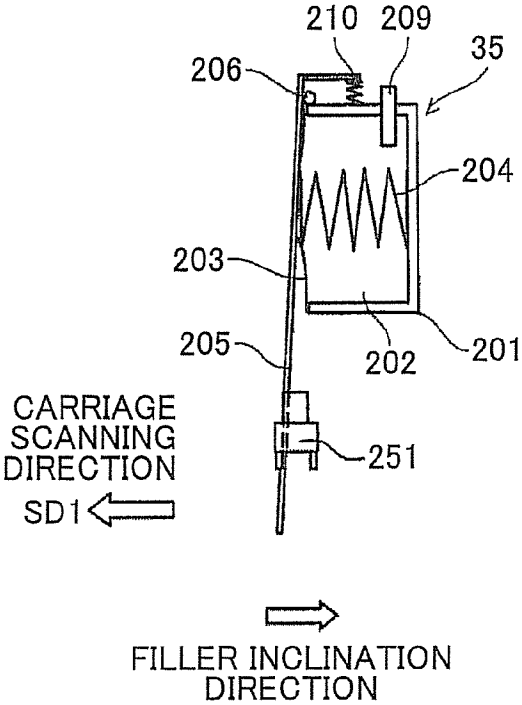

Next, a fourth embodiment of the present invention will be described with reference to FIGS. 20, 21A and 21B. It is noted that FIG. 20 illustrates pressure variations in the sub-tank 35 during scanning operations of the carriage 33, and FIGS. 21A and 21B illustrate the scanning directions of the carriage 33 and inclination of the displacement member 205.

First, when the carriage 33 is moved in the main scan directions SD1 and SD2 in a going and returning manner, deceleration and acceleration of the carriage 33 are carried out at a time of changing the moving direction (turning) between the going direction and the returning direction. Thereby, as shown in FIG. 20, pressure variations occur in the sub-tank 35.

In such a state, when the ink is supplied to the sub-tank 35 from the liquid feeding pump 241, pressure caused by the ink being supplied and pressure caused by the carriage being moved are applied to the inside of the sub-tank 35 at the same time. Thereby, stability of the negative pressure in the inside of the sub-tank may be broken.

Therefore, when the ink is supplied to the sub-tank 35 during scanning operations (moving in the main scan directions SD1 and SD2) of the carriage 33, it is preferable to carry out supplying the ink to the sub-tank 35 when the carriage 33 moves in the main scan direction SD1 or SD2 at a constant speed where an influence of the pressure variation due to driving of the carriage 33 is small. When supplying the ink to the sub-tank 35 is carried out while the carriage 33 moves at a constant speed, in comparison to a case where supplying the ink to the sub-tank 35 is carried out while the carriage 33 is accelerated or decelerated, a moving amount of the displacement member 205 is small. Therefore, an erroneous detection by the first sensor 251 is not likely to occur.

Further, behavior of the displacement member 205 that is pressed to and in contact with the flexible film 203 of the sub-tank 35 changes depending on the direction of movement of the carriage 33. That is, as shown in FIG. 21A, while the carriage 33 is moved in the main scan direction SD1, the displacement member 205 provided to the side of the moving direction is given force in a direction toward the flexible film 203 which the displacement member 205 is pressed to and in contact with. Therefore, in this case, movement of the displacement member 205 becomes smaller. On the other hand, the displacement member 205 provided to the side, opposite to the moving direction SD2 (see FIG. 21B), is given force in a direction for being away from the flexible film 203 which the displacement member 205 is pressed to and in contact with. Therefore, in this case, movement of the displacement member 205 becomes larger.

Therefore, when the ink is supplied to the sub-tank 33 while the carriage 33 is moving in the main scan direction SD1 or SD2, the ink is supplied to the sub-tank when the direction in which the carriage is moving coincides with the direction in which the flexible film 203 (the displacement member 205) is disposed to the sub-tank 33 (see FIG. 21A). Thereby, it is possible to supply the ink to the sub-tank 25 where the negative pressure in the sub-tank 35 is stable even while the carriage 33 is moved in the main scan direction.

Figure 22:
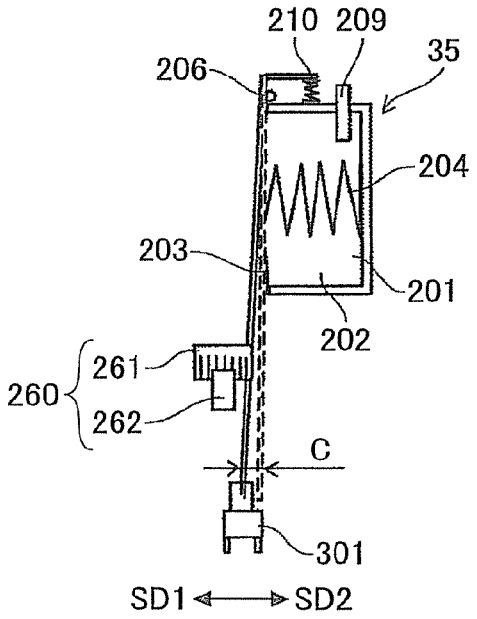
FIG. 22 schematically illustrates a sub-tank for illustrating a fifth embodiment of the present invention.

Next, a fifth embodiment of the present invention will be described with reference to FIG. 22. It is noted that FIG. 22 is a schematic sectional plan view illustrating the fifth embodiment.

Here, as the first sensor 251, a linear encoder 260 is used. The linear encoder 260 includes an encoder scale 261 and an encoder sensor 262 configured to read the encoder scale 261. The encoder scale 261 is provided to the displacement member 205, and the encoder sensor 262 is provided to the carriage 33.

Thereby, it is possible to directly measure the distance (displacement amount) until when the second sensor 301 detects the displacement member 205, it is possible to thus obtain the displacement amount C corresponding to a displacement of the flexible film 203 of the sub-tank 35, and thus it is possible to detect the ink amount in the sub-tank 35.

Figure 23:
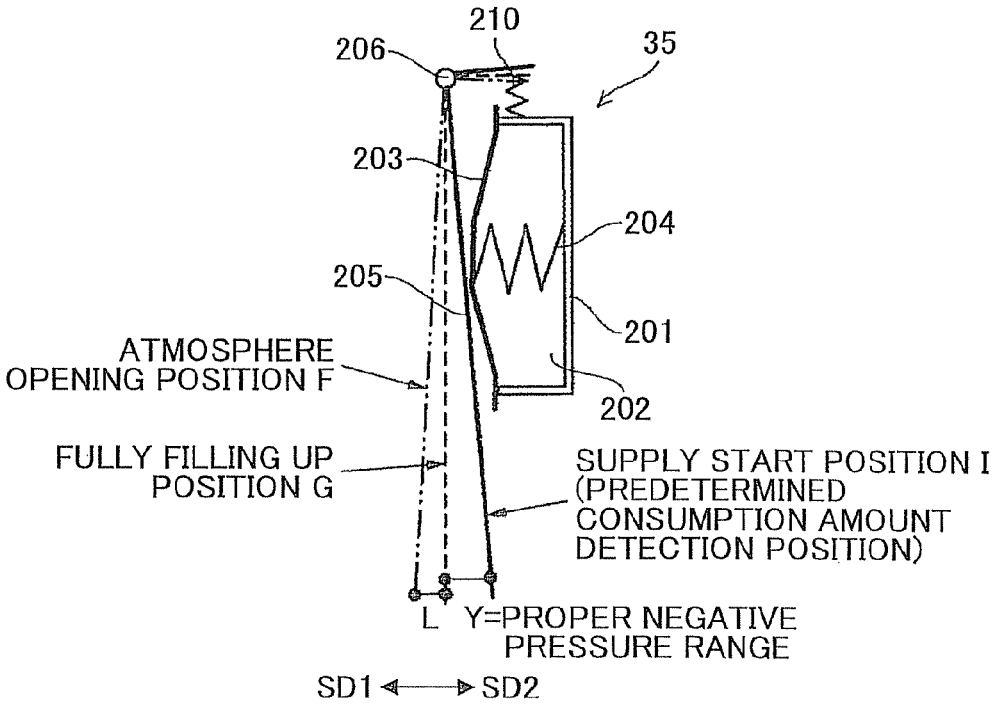
FIG. 23 illustrates respective positions of a displacement member according to a sixth embodiment of the present invention.
Figure 24A:
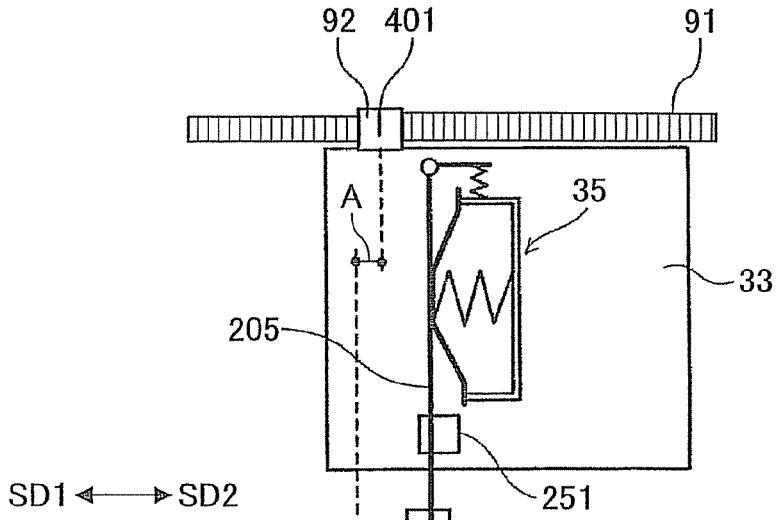
FIGS. 24A and 24B illustrate detection of a differential supply amount according to the sixth embodiment of the present invention
Figure 24B:
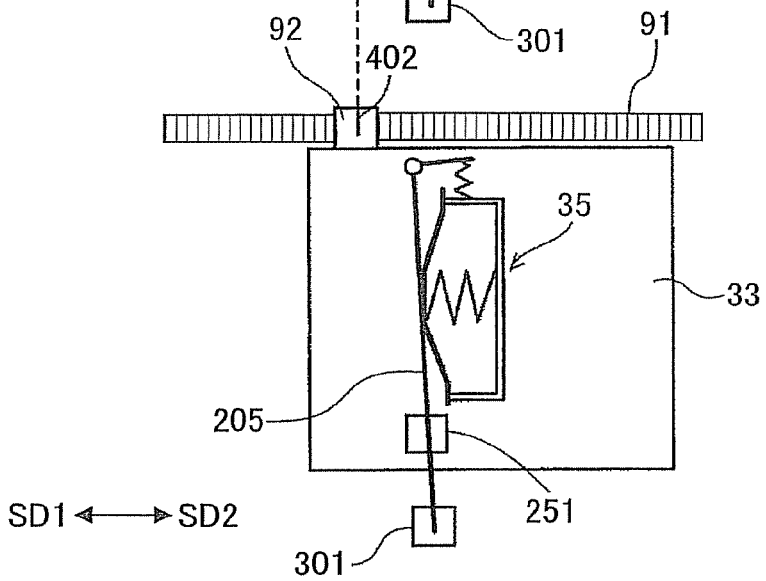
Figure 25B:
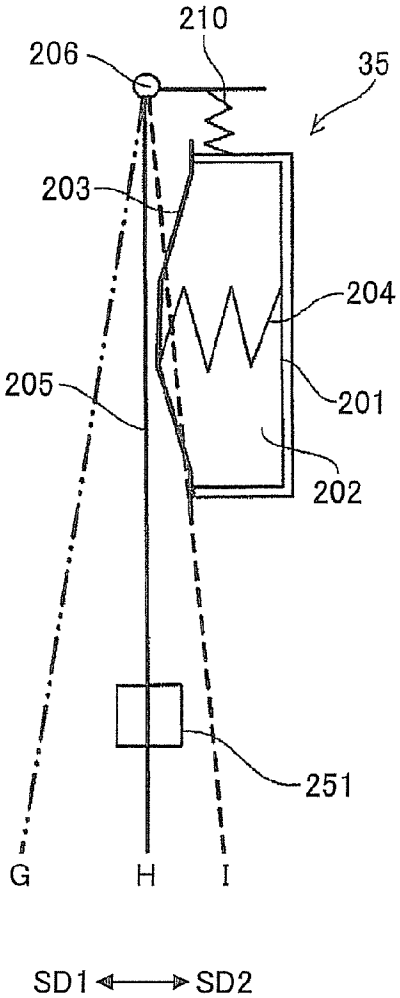
FIGS. 25A and 25B illustrate operation and function according to the sixth embodiment of the present invention.
Figure 25A:
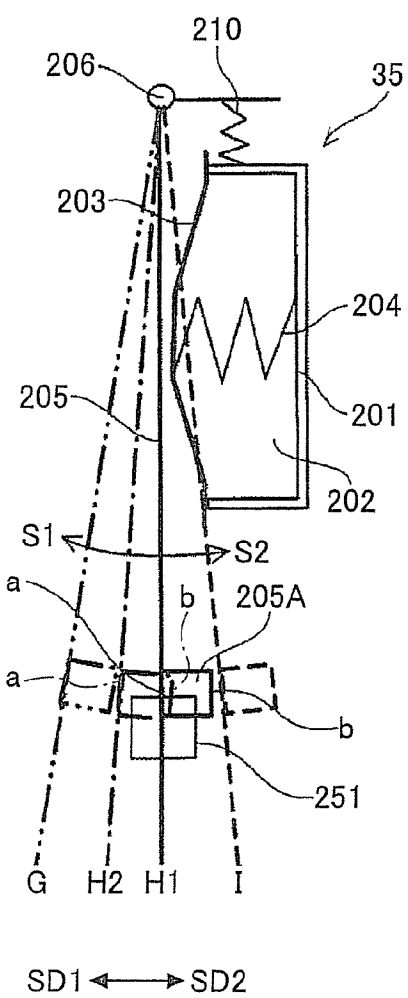

Next, a sixth embodiment of the present invention will be described with reference to FIGS. 23, 24A, 24B, 25A and 25B. It is noted that FIG. 23 illustrates respective displacement positions of the displacement member 205 according to the sixth embodiment. FIGS. 24A and 24B illustrate an operation of detecting the differential supply amount. FIGS. 25A and 25B illustrate operations and functions of the sixth embodiment.

First, a proper range Y of negative pressure (proper negative pressure range) is defined as a range between the fully filling up position (ink amount upper limit value) "G" of the displacement member 205 and the supply start position (ink amount lower limit value) "I" of the displacement member 205. At this time, the atmosphere opening position "F" of the displacement member 205 is a position where the displacement member 205 is further opened from the fully filling up positron "G".

The ink is supplied to the sub-tank 35 in a state where the sub-tank 35 is opened to (or communicates with) the atmosphere, then the sub-tank 35 is separated from the atmosphere, and the position of the displacement member 205 is detected by the second sensor 301 (the atmosphere opening position "F") (see FIG. 11A). Therefrom, the carriage 35 is moved in the main scan direction SD1 by a designated count L (which may be measured by the linear encoder 90) (corresponding to the displacement amount between the atmosphere opening position "F" and the fully filling up position "G" (see FIG. 23)). Then, the ink is suctioned (fed in reverse) to the main tank 10 from the sub-tank 35 until the second sensor 301 detects the displacement member 205 again. The displacement position of the displacement member 205 with respect to the carriage 33 at this time is determined as the atmosphere opening position "G". Thereby, as described above, it is possible to at any time set the fixed negative pressure in the sub-tank 35 to the fully filling up position "G" of the displacement member 205 with respect to the carriage 33 without being affected by cumulation of scattering of the sizes or such of the parts/components. Further, in a case where the flexible film 203 expands or contracts due to the temperature or the humidity, it is possible to at any time set the fixed negative pressure in the sub-tank 35 to the fully filling up position "G" of the displacement member 205 with respect to the carriage 33 by again setting the fully filling up position "G".

For this purpose, the displacement member 205 that changes its position according to the ink remaining amount in the sub-tank 35; the first sensor 251 made of a transmission-type photo sensor fixed to the carriage 33 for detecting the displacement member 205; and the second sensor 301 fixed to the body of the image forming apparatus 1 are provided. Then, as shown in FIGS. 24A and 24B, a difference "A" between the position 401 of the carriage 33 (see FIG. 24A) where the displacement member 205 is at the fully filling up position "G" with respect to the carriage 33 and the second sensor 301 detects the displacement member 205 and the position 402 of the carriage 33 (see FIG. 24B) where the first sensor 251 detects the displacement member 205 is stored in the RAM 503 or such. Then, during a printing operation, the ink discharge amount is measured (through counting the ink droplets), and the ink supply amount to the sub-tank 35 from the main tank 10 is controlled and corrected by using the stored difference "A".

That is, by providing the first sensor 251 to the carriage 33, it is possible to supply the ink to the sub-tank 35 until the first sensor 251 detects the displacement member 205 even during the printing operation, as described above. Further, it is possible to further supply the ink to the sub-tank 35 to the fully filling up position, as a result of converting the above-mentioned difference "A" (corresponding to the displacement amount "C") into the corresponding total ink supply amount (the differential supply amount), the corresponding ink supply time period, the corresponding total number of rotations of driving the liquid feeding pump 241, or such, and supplying the ink to the sub-tank 35 by the converted amount.

Thus, as described above, it is possible to avoid influence of cumulation of scattering of the sizes or such of the parts/components, and also, influence of expanding/contracting of the flexible film 203 due to the temperature and/or the humidity, by again setting the fully filling up position "G". Further, by having a table indicating a change in the fully filling up position depending on the temperature and/or the humidity, again setting the fully filling up position "G" including opening the sub-tank 35 to the atmosphere becomes unnecessary. Further, as to the supply start position "I" (see FIG. 23), instead of carrying out the above-mentioned soft counting for measuring the entirety of the ink discharge amount (ink consumption) up to the supply start position "I" during printing operation, it is possible to obtain higher accuracy, as a result of first obtaining the ink discharge amount (ink consumption) by detecting the displacement member 205 using the first sensor 251, and then obtaining the remaining ink discharge amount (ink consumption) up to the supply start position "I" by soft counting. This is because in consideration of the scattering in detecting of the ink supply amount by the liquid feeding pump 241 and the scattering in the result of soft counting, it is preferable to rather depend on the detection accuracy of the first sensor 251.

Further, in the sixth embodiment, as shown in FIG. 25A, at least two detection regions are provided in the displacement directions of the displacement member 205 to be detected by the first sensor 251. It is noted that the displacement directions of the displacement member 205 include the displacement direction S1 in which the displacement member moves when the liquid (ink) remaining amount in the sub-tank 35 increases, and the displacement direction S2 in which the displacement member 205 moves when the liquid (ink) remaining amount in the sub-tank 35 decreases.

Further, a detection part 205A having a large width in the displacement directions is provided, and an end (edge) "a" in the displacement direction S1 and another end (edge) "b" in the displacement direction S2 of the detection part 205A are used as the detection regions "a" and "b", respectively (see FIG. 25A). Further, the displacement position of the displacement member 205 when the first sensor 251 detects the detection region "a" is referred to as a first sensor detection position "H1", and the displacement position of the displacement member 205 when the first sensor 251 detects the detection region "b" is referred to as a first sensor detection position "H2".

As the first sensor 251 of the carriage 33, the transmission-type photo sensor is used, and the position of the first sensor 251 is fixed to the carriage 33. As an example, as mentioned above, both edges "a" and "b" of (the detection part 205A of) the displacement member 205 in the displacement directions are used as the respective detection regions "a" and "b". That is, the displacement member 205 has a thickness (or a width) in the displacement directions, and the thickness is thus used. It is noted that the above-mentioned "detection part 205A" is used for the purpose of clearly showing the two direction regions "a" and "b". Thus, the fixed first sensor 251 can detect both edges "a" and "b" of the displacement member 205. That is, when the displacement member 205 moves in the displacement direction S2, the region at which the detection result of the first sensor 251 changes from "light being transmitted" into "light being blocked" is a first detection region (the detection region "b" of the detection part 205A), and the region at which the detection result of the first sensor 251 changes from "light being blocked" into "light being transmitted" is a second detection region (the detection region "a" of the detection part 205A).

Then, as shown in FIG. 25A, in a case where the ink is supplied to the sub-tank 35 from the main tank 10 without using the second sensor 301, the ink is supplied to the sub-tank 35 when the ink remaining amount in the sub-tank 35 becomes the predetermined liquid consumed amount (corresponding to the predetermined consumption amount detection position "I" or the supply start position "I") at which the ink remaining amount is smaller than the ink remaining amount at the position of the displacement member 205 where the first sensor 251 detects the displacement member 205 (the first sensor detection position H). Then, such control is carried out that, from when the first sensor 251 detects the detection region "a" (the first sensor detection position H1), soft counting for measuring the ink consumption amount to determine the supply start position "I" is started. On the other hand, after supplying the ink to the sub-tank 35 is started, from when the first sensor 251 detects the detection region "b" (the first sensor detection position H2), supply of the differential supply amount of ink is started.

Thereby, when the liquid (ink) is supplied to the sub-tank 35, the ink is supplied by using the deferential supply amount from the first sensor detection positron H2 to the fully filling up position G of the displacement member 205. When the ink is discharged from the recording head 34, soft counting for measuring the ink consumption amount is carried out from when the first sensor 251 has detected the displacement member 205 where the displacement member 205 is at the first sensor detection position H1. Thereby, in the configuration described with reference to FIG. 25A, a range of using the detection results of the first sensor 251 is created. That is, in the range between the detection regions "a" and "b" or between the first sensor detection positions H1 and H2, the detection results of the first sensor 251 can be used. Thereby, it is possible to narrow the range of supplying the ink by using the differential supply amount and narrow the range of soft counting, accordingly. It is noted that supplying the ink by using the differential supply amount and the result of soft counting have relatively large amounts of scattering, respectively. Thereby, it is possible to increase the ink supply amount for one time and the ink discharge amount for one time, thus it is possible to reduce the frequency of times of supplying the ink to the sub-tank 35, and thus, it is possible to elongate the lifetime of the liquid feeding pump 241.

In contrast thereto, in a case where the detection region of the displacement member 205 is one point as shown in FIG. 25B, supplying the ink by using the differential supply amount and soft counting are carried out with respect to the first sensor detection position H of the displacement member 205 detected by the first sensor 251. That is, when the liquid (ink) is supplied to the sub-tank 35, the ink is supplied by using the deferential supply amount from the first sensor detection positron H to the fully filling up position G of the displacement member 205. When the ink is discharged from the recording head 34, soft counting for the ink consumption amount is carried out from when the first sensor 251 has detected the displacement member 205 where the displacement member 205 is at the first sensor detection position H to the supply start position I of the displacement member 205. Thereby, the range of supplying the ink by using the differential supply amount is widened and the range of soft counting is widened in comparison to the above-mentioned case shown in FIG. 25A. And thus, in consideration of the possible scattering of the differential supply amount and the result of soft counting, it may be necessary to consider relatively large margins. As a result, it may be necessary to decrease the ink supply amount for one time and the ink discharge amount for one time, the frequency of times of supplying the ink to the sub-tank 35 may thus increase, accordingly, and thus, the lifetime of the liquid feeding pump 241 may be shortened, in comparison to the case of FIG. 25A.

It is noted that the description has been made for the example where the displacement member 205 has the two detection regions "a" and "b". However, embodiments of the present invention are not limited to this example. As mentioned above with reference to FIG. 22, the displacement member 205 may have a multi-point detection part such as the encoder scale 261 of the linear encoder 260. Thereby, the ink remaining amount in the sub-tank 35 can be monitored linearly, and thus, it is possible to set the displacement member 205 of the sub-tank 35 at an over filling position at which the ink is filled more than the fully filling up position by only the first sensor 251 (as the linear encoder 260). Further, it is possible to supply the ink to the sub-tank 35 even during the above-mentioned cleaning operation. Further, it is possible to omit the second sensor 301. Further, there may be a case where because printing is carried out with a high coverage rate or such, the rate of supplying the ink to the sub-tank 35 may not be sufficient when supplying the ink is started from the supply start position I. In such a case, supplying the ink to the sub-tank 35 may be carried out prior to reaching the supply start position I by using the linear encoder 260 or such as the first sensor 251.

Here, another example of disposing the first sensor 251 and the second sensor 301 will be described with reference to FIG. 26.

Figure 26:
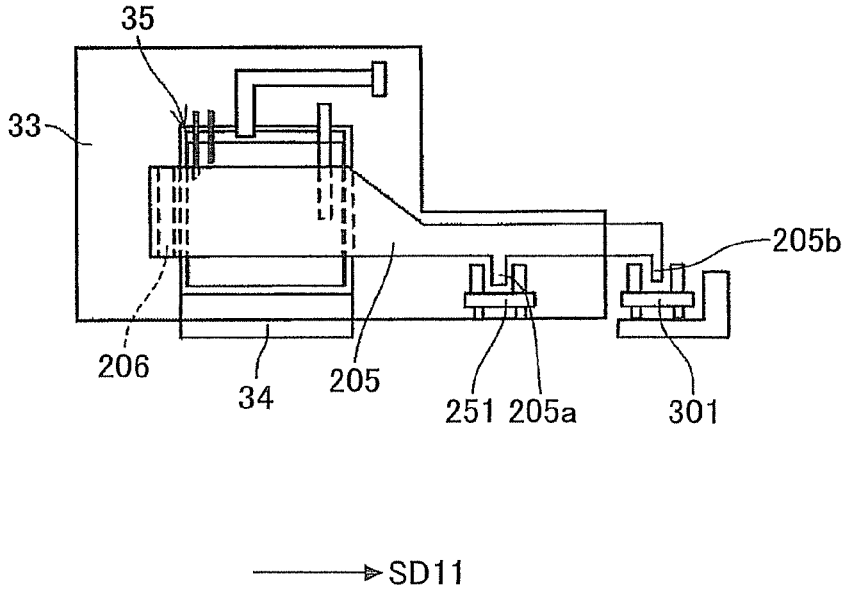
FIG. 26 illustrates an example of an arrangement of a first sensor and a second sensor according to the sixth embodiment of the present invention.

The example shown in FIG. 26 is such that detection parts 205*a* and 205*b*, each extending downward as shown in FIG. 26, having different lengths from the supporting shaft 206 (swinging fulcrum), are provided to the displacement member 205 of the sub-tank 35. The first sensor 251 provided to the carriage 33 detects the detection part 205*a* and the second sensor 301 provided to the body of the image forming apparatus 1 detects the detection part 205*b*.

It is noted that instead of providing the two detection regions "a" and "b" to the displacement member 205 itself described above with reference to FIG. 25A, a similar function can be obtained when two of the first sensors are provided, and these two first sensors detect the displacement member 205 at different positions, respectively.

Figure 27A:
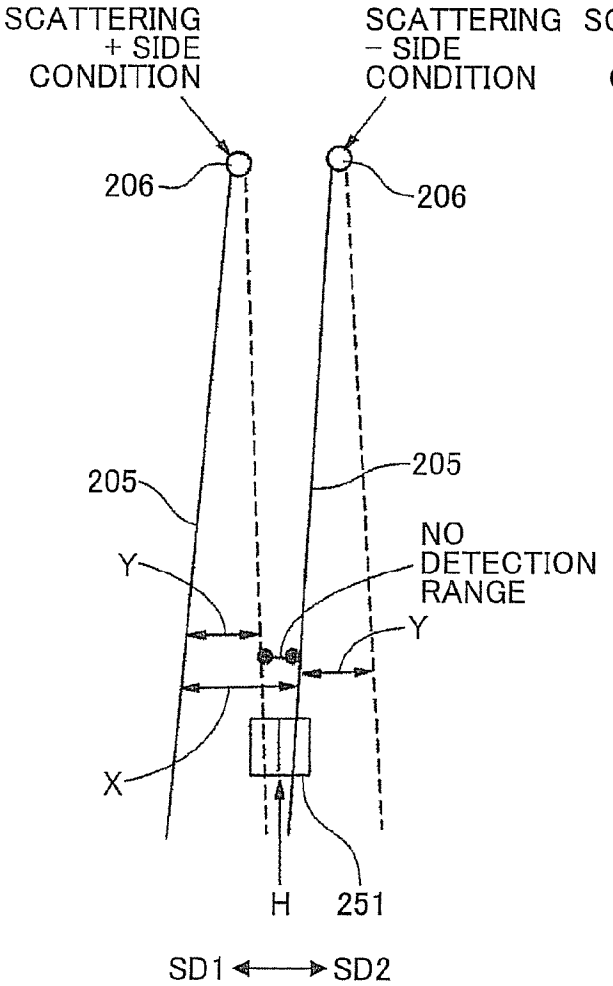
FIGS. 27A and 27B illustrate a seventh embodiment of the present invention.
Figure 27B:
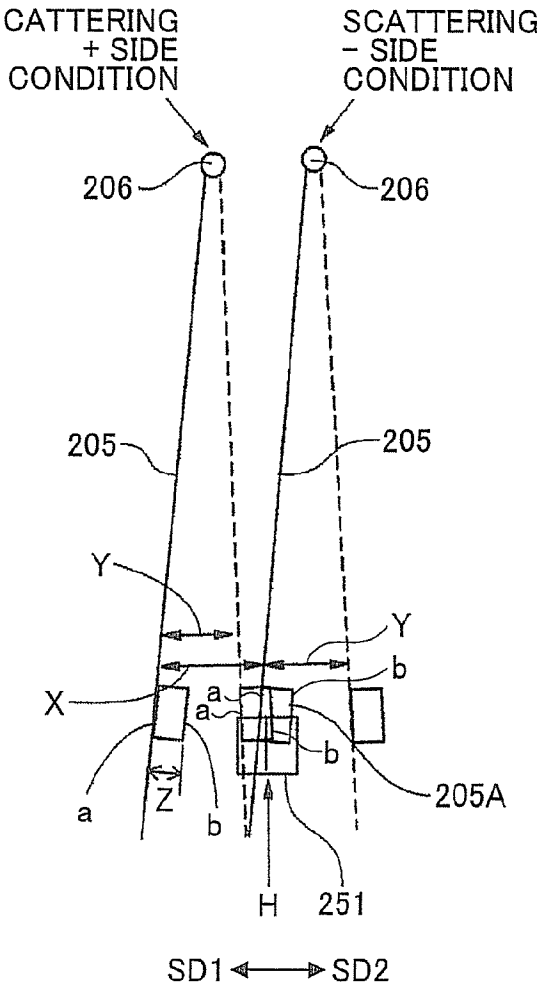

Next, a seventh embodiment of the present invention will be described with reference to FIGS. 27A and 27B. FIGS. 27A and 27B illustrate the seventh embodiment.

Here, a place (detection region) of the displacement member 205 to be detected by the first sensor 251 is switched depending on a relationship between "a differential amount between the fully filling up position of the displacement member 205 detected by the second sensor 301 and the position of the displacement member 205 detected by the first sensor 251" and "a distance X of scattering below described".

That is, as shown in FIG. 27A, the position of the displacement member 205 may vary, for example, by the distance X between respective positions indicated "scattering+side condition" and "scattering−side condition", due to a condition such as scattering of the sizes or such of the parts/components or a change in the temperature and/or the humidity. At this time, when the distance X of scattering of the positional relationship between the first sensor 251 and the displacement member 205 is larger than the displacement range Y of the displacement member 205 between the fully filling up position (solid line) and the supply start positron (broken line) (X>Y), the first sensor 251 may not be able to detect the displacement member 205 when the negative pressure in the sub-tank 35 is within the proper range corresponding to the displacement range Y depending on the condition.

Therefore, as shown in FIG. 27B, the displacement member 205 has a detection part 205A having two detection regions "a" and "b" to be detected by the first sensor 251, and a distance Z between the two detection regions "a" and "b" is such that X<Y+Z. Thereby, it is possible that the first sensor 251 is capable of detecting the displacement member 205 when the negative pressure in the sub-tank 35 is within the proper range corresponding to the displacement range Y, as a result of the two detection regions "a" and "b" being switched depending on the relationship between the displacement range Y and the distance X of scattering. That is, in the condition of X>Y, and also, when the above-mentioned "scattering+side condition" occurs, the detection region "b" is used. On the other hand, in the condition of X>Y, and also, when the above-mentioned "scattering−side condition" occurs, the detection region "a" is used.

In this case, as a result of the two places (detection regions) "a" and "b" that are both edges of the width of the part of the displacement member 205 in the displacement directions being used to be detected by the first sensor 251, it is possible to provide a configuration such that the two places "a" and "b" are detected with a simple configuration at a low price. Further, the distance Z between the two places "a" and "b" to be detected can be easily set by setting the width of the part.

Figure 28:
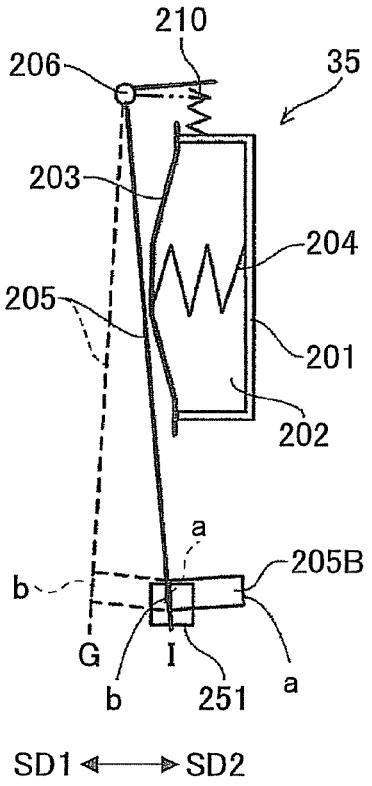
FIG. 28 illustrates an eighth embodiment of the present invention.

Next, with reference to FIG. 28, an eighth embodiment of the present invention will be described. FIG. 28 illustrates the eighth embodiment.

According to the eighth embodiment, the second sensor 301 in each of the above-mentioned embodiments is not used, and the supply start position (for the sub-tank 35) and the fully filling up position of the displacement member 205 are detected by only the first sensor 251 provided to the carriage 33. However, in the eighth embodiment, it is also possible that the second sensor 301 is used together with the first sensor 251.

That is, as shown in FIG. 28, a detection part 205B is provided to the displacement member 205 having a width in the displacement directions corresponding to the supply start position (for the sub-tank 35) and the fully filling up position of the displacement member 205. Opposing edges in the displacement directions of the detection part 205B are used as detection regions "a" and "b", respectively. Supplying the ink to the sub-tank 35 is started when the first sensor 251 detects the detection region "b" of the detection part 205B of the displacement member 205. The supplying the ink to the sub-tank 35 is stopped when the first sensor 251 detects the detection region "a" of the detection part 205B of the displacement member 205 as it is determined that the displacement member 205 is at the fully filling up position. It is noted that the positions of the two regions "a" and "b" of the detection part 205B of the displacement member 205 are set to positions where the negative pressure in the sub-tank 35 is within the proper range. Thereby, it is possible to carry out management of negative pressure in the sub-tank 35 with simple configuration and control.

Thus, the displacement member 205 that changes its position according to the liquid (ink) remaining amount in the sub-tank 35 is provided to the sub-tank 35. As shown in FIG. 25, the carriage 33 has the detection part (251) that detects at least two or more of the detection regions "a" and "b" of the displacement member 205. Further, the control part (500) controls supplying the liquid (ink) to the sub-tank 35 in such a manner that the displacement member 205 changes its position between the position (I) at which one ("b") of the at least two or more of the detection regions is detected by the detection part (251) and the position (G) at which another ("a") of the at least two or more of the detection regions is detected by the detection part (251). Thereby, it is possible to supply the appropriate amount of the liquid (ink) to the sub-tank 35 from the main tank 10 even while the carriage 33 is moving, and thus, it possible to improve the printing speed.

Figure 29A:
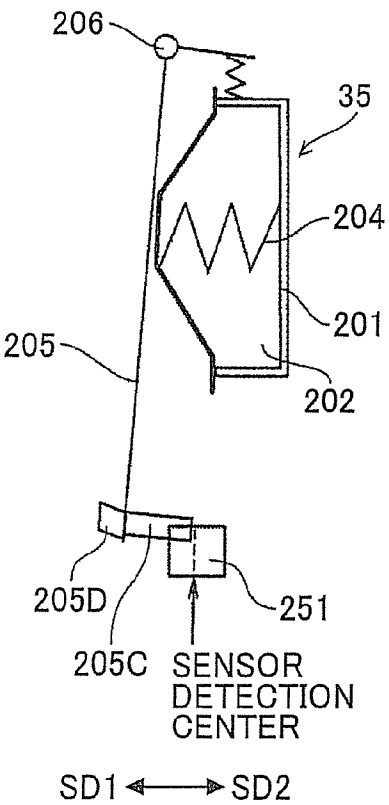
FIGS. 29A, 29B and 29C illustrate a ninth embodiment of the present invention
Figure 29B:
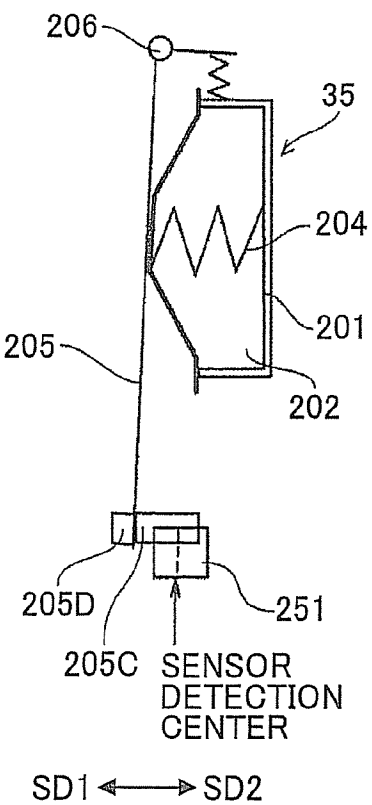
Figure 29C:
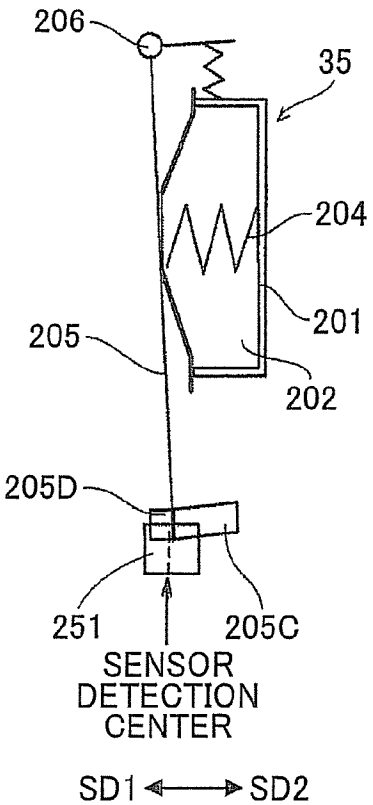

Next, a ninth embodiment of the present invention will be described with reference to FIGS. 29A, 29B and 29C. FIGS. 29A, 29B and 29C illustrate the ninth embodiment.

In the ninth embodiment, the displacement member 205 has detection parts 205C and 205D. The detection part 205C is made of a light blocking material and the detection part 205D is made of a material having transmittance mid-way between light blocking and light transmitting. Thereby, as a result of the first sensor 251 being made of a transmission-type photo sensor, it is possible to detect that the displacement position of the displacement member 205 exists in a first range (a) (see FIG. 29A) where the detection parts 205*c* and 205D are out of the center of detection of the first sensor 251 (at a light transmitting state); a second range (b) (see FIG. 29B) where the detection part 205C is at the center of detection of the first sensor 251 (at a light blocking state); and a third range (c) (see FIG. 29C) where the detection part 205D is at the center of detection of the first sensor 251 (at a light semi-transmitting state or a state of detecting predetermined light transmittance).

Thus, according to the ninth embodiment, it is determined which one of the first range (a), the second range (b) and the third range (c) the displacement member 205 exists in by using the first sensor 251 and the displacement member 205, and during printing operations, control of supplying the ink to the sub-tank 35 and stopping supplying the ink to the sub-tank 35 is carried such that the displacement member 205 is positioned within the second range (b).

Thus, according to the ninth embodiment, even in a case where, for example, at a time of the power having been just turned on in the image forming apparatus 1, and thus the displacement member 205 is out of the proper range of negative pressure (the second range (b)), it is possible to determine whether the displacement member 205 is outside of the fully filling up position or inside of the supply start position. For this purpose, the first range (a) is set as the position outside of the fully filling up position (see FIG. 29A), and the third range (c) is set as the position inside of the supply start position (see FIG. 29C). Thus, a fail safe system is realized such that it is possible to detect that the displacement member 205 is within the second range (b) that exists between the first range (a) and the third range (c).

It is noted that it is also possible that the first range (a) corresponds to the light transmitting state for the first sensor 251 and each of the second and third range (b) and (c) corresponds to the light blocking state for the first sensor 251. Then, control is carried out such that the displacement member 205 is to be positioned without fail at the fully filling up position (at the boundary between the first range (a) and the second range (b)) at a time of power being just turned on in the image forming apparatus 1.

The above-mentioned control (processing) of supplying the ink to the sub-tank 35 may be carried out by a computer included in the control part 500 according to a program stored in the ROM 502, for example. The program may be downloaded to the information processing apparatus (host 600) and installed in the image forming apparatus 1. Further, it is possible to configure an image forming system as a result of the image forming apparatus 1 according to any of the above-described embodiments of the present invention and the information processing apparatus 600 being combined, or the image forming apparatus 1 and the information processing apparatus 600 having the program installed for carrying out the processing according to any one of the above-described embodiments of the present invention being combined.

The present invention is not limited to the specifically disclosed embodiments, and variations and modifications may be made without departing from the scope of the present invention.

The present application is based on Japanese Patent Applications Nos. 2010-056534 and 2010-182734 filed on Mar. 12, 2010 and Aug. 18, 2010, the entire contents of which are hereby incorporated herein by reference.

The invention claimed is:

1. An image forming apparatus comprising:

a recording head to discharge liquid droplets;

a sub-tank to contain liquid to be supplied to the recording head;

a carriage to carry the head and the sub-tank;

a main tank to contain the liquid to be supplied to the sub-tank; and a liquid feeder to supply the liquid from the main tank to the sub-tank, wherein the sub-tank has a displacement member that changes its position according to a remaining amount of the liquid in the sub-tank, a first detector to detect that the displacement member is at a predetermined first position is provided to the carriage, a second detector to detect that the displacement member is at a predetermined second position is provided to a body of the image forming apparatus, the remaining amount of the liquid in the sub-tank when the displacement member is at the first position is smaller than the remaining amount of the liquid in the sub-tank when the displacement member is at the second position, a differential supply amount corresponding to a displacement amount of the displacement member between the position at which the displacement member is detected by the first detector and the position at which the displacement member is detected by the second detector is detected and stored, and the liquid feeder supplies the liquid to the sub-tank, in the differential supply amount, after the first detector detects the displacement member when the liquid is supplied to the sub-tank from the main tank without using the second detector.

2. The image forming apparatus as claimed in claim 1, further comprising a controller to control the supplying of the liquid of the differential supply amount by a time period of driving the liquid feeding pump required for the displacement member moving from the first position to the second position.

3. The image forming apparatus as claimed in claim 1, further comprising a controller to control the supplying of the liquid of the differential supply amount by a number of rotations of the liquid feeding pump required for the displacement member moving from the first position to the second position.

4. The image forming apparatus as claimed in claim 1, further comprising a controller to control the supplying of the liquid of the differential supply amount by detecting a displacement amount of the displacement member.

5. The image forming apparatus as claimed in claim 1, further comprising:

a temperature/humidity detector to detect at least one of an environmental temperature and an environmental humidity of the image forming apparatus, wherein when a difference between a detection result of the temperature/humidity detector and a threshold value becomes equal to or more than a predetermined value, an operation of detecting the differential supply amount is carried out.

6. The image forming apparatus as claimed in claim 1, wherein the first position is a position such that when at least any one of an environmental temperature and an environmental humidity of the image forming apparatus is a predetermined value, a displacement amount of the displacement member between the first position and the second position falls within a predetermined range.

7. The image forming apparatus as claimed in claim 1, further comprising a controller to control the supplying of the liquid to the sub-tank from the main tank without using the second detector when an amount of the liquid discharged from the recording head exceeds a predetermined amount.

8. The image forming apparatus as claimed in claim 1, further comprising a controller, wherein if the first detector does not detect the displacement member even when an amount of the liquid discharged from the recording head becomes equal to or more than a predetermined amount, the controller controls the recording head to discharge the liquid until the first detector detects the displacement member.

9. The image forming apparatus as claimed in claim 8, wherein when a number of times of carrying out the control of discharging the liquid from the recording head until the second detector detects the displacement member becomes a predetermined number of tunes, the controller stops the operation of discharging the liquid droplets from the recording head.

10. The image forming apparatus as claimed in claim 1, wherein while the carriage is carrying out a scanning operation, the liquid feeder supplies the liquid to the sub-tank when a scan direction of the carriage coincides with a direction in which the displacement member of the sub-tank exists with respect to the sub-tank.

11. The image forming apparatus as claimed in claim 1, wherein when the first detector detects the differential supply amount, the liquid is suctioned from the sub-tank to the main tank and the displacement member is changed in its position until the first detector detects the displacement member.

12. The image forming apparatus as claimed in claim 1, wherein when the liquid is to be supplied to the sub-tank from the main tank without using the second detector, the liquid is supplied from the main tank to the sub-tank when a liquid consumption amount becomes a predetermined liquid consumption amount where the remaining amount of the liquid in the sub-tank is less than that of a state where the first detector has detected the displacement member.

13. The image forming apparatus as claimed in claim 12, wherein the displacement member has at least two detection regions in displacement directions, the liquid consumption amount is calculated from when the first detector detects the detection region of the displacement member on a side where the remaining amount of the liquid in the sub-tank is smaller, and the liquid feeder tarts the supplying of the liquid by the differential supply amount from when the first detector detects the detection region of the displacement member on a side where the remaining amount of the liquid in the sub-tank is larger.

14. The image forming apparatus as claimed in claim 1, wherein the displacement member has at least two detection regions in displacement directions, the detection region of the displacement member to be detected by the first detector for supplying the liquid of the differential supply amount is switched according to scattering of a positional relationship between the first detector and the displacement member.

15. The image forming apparatus as claimed in claim 14, wherein the at least two detection regions are both ends of the displacement member n the displacement directions.

* * * * *